US007649516B2

(12) United States Patent
Azami et al.

(10) Patent No.: US 7,649,516 B2
(45) Date of Patent: Jan. 19, 2010

(54) LIGHT EMITTING DEVICE

(75) Inventors: Munehiro Azami, Kanagawa (JP); Yoshifumi Tanada, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 615 days.

(21) Appl. No.: 11/211,075

(22) Filed: Aug. 25, 2005

(65) Prior Publication Data

US 2006/0066530 A1 Mar. 30, 2006

Related U.S. Application Data

(62) Division of application No. 10/198,753, filed on Jul. 16, 2002, now Pat. No. 6,958,750.

(30) Foreign Application Priority Data

Jul. 16, 2001 (JP) ..... 2001-216029
Sep. 18, 2001 (JP) ..... 2001-283998

(51) Int. Cl.
*G09G 3/36* (2006.01)
*G09G 3/30* (2006.01)

(52) U.S. Cl. ..... 345/82; 345/76

(58) Field of Classification Search ..... 345/76, 345/82, 77, 83, 92; 315/169.1, 169.3
See application file for complete search history.

(56) References Cited

U.S. PATENT DOCUMENTS 3,506,851 A 4/1970 Polkinghorn et al.
3,774,055 A 11/1973 Bapat
3,898,479 A 8/1975 Proebsting
4,090,096 A 5/1978 Nagami
4,390,803 A 6/1983 Koike
4,412,139 A 10/1983 Horninger
4,633,105 A 12/1986 Tsujimoto
4,804,870 A 2/1989 Mahmud
4,959,697 A 9/1990 Shier et al.
5,467,038 A 11/1995 Motley et al.

(Continued)

FOREIGN PATENT DOCUMENTS

EP 1 005 013 5/2000

(Continued)

OTHER PUBLICATIONS

Korean Patent Office Action (Korean Patent Application 2002-0041533), dated Mar. 21, 2008, 13 pages with English translation.

(Continued)

*Primary Examiner*—Kevin M Nguyen
(74) *Attorney, Agent, or Firm*—Fish & Richardson P.C.

(57) ABSTRACT

A pixel having a structure in which low voltage drive is possible is provided by a simple process. A digital image signal input from a source signal line is input to the pixel through a switching TFT. At this point, a voltage compensation circuit amplifies the voltage amplitude of the digital image signal or transforms the amplitude, and applies the result to a gate electrode of a driver TFT. On-off control of TFTs within the pixel can thus be performed normally even if the voltage of a power source for driving gate signal lines becomes lower.

32 Claims, 26 Drawing Sheets

U.S. PATENT DOCUMENTS

| | | | | |
|---|---|---|---|---|
| 5,548,143 | A | 8/1996 | Lee | |
| 5,643,826 | A | 7/1997 | Ohtani et al. | |
| 5,694,061 | A | 12/1997 | Morosawa et al. | |
| 5,870,071 | A | 2/1999 | Kawahata | |
| 5,889,291 | A | 3/1999 | Koyama et al. | |
| 5,949,271 | A | 9/1999 | Fujikura | |
| 5,952,991 | A | 9/1999 | Akiyama | |
| 6,040,810 | A | 3/2000 | Nishimura | |
| 6,049,228 | A | 4/2000 | Moon | |
| 6,091,393 | A | 7/2000 | Park | |
| 6,229,506 | B1 | 5/2001 | Dawson et al. | |
| 6,229,508 | B1 * | 5/2001 | Kane | 345/82 |
| 6,359,605 | B1 * | 3/2002 | Knapp et al. | 345/76 |
| 6,384,804 | B1 | 5/2002 | Dodabalapur et al. | |
| 6,501,098 | B2 | 12/2002 | Yamazaki | |
| 6,501,448 | B1 | 12/2002 | Komiya et al. | |
| 6,501,466 | B1 | 12/2002 | Yamagishi et al. | |
| 6,522,323 | B1 | 2/2003 | Sasaki et al. | |
| 6,524,138 | B1 | 2/2003 | Li et al. | |
| 6,525,704 | B1 * | 2/2003 | Kondo et al. | 315/169.3 |
| 6,535,185 | B2 * | 3/2003 | Kim et al. | 345/76 |
| 6,542,138 | B1 | 4/2003 | Shannon et al. | |
| 6,577,302 | B2 * | 6/2003 | Hunter et al. | 345/204 |
| 6,580,408 | B1 * | 6/2003 | Bae et al. | 345/76 |
| 6,686,899 | B2 | 2/2004 | Miyazawa et al. | |
| 6,693,610 | B2 | 2/2004 | Shannon et al. | |
| 6,730,966 | B2 | 5/2004 | Koyama | |
| 6,813,332 | B2 | 11/2004 | Nagao et al. | |
| 6,982,462 | B2 | 1/2006 | Koyama | |
| 2001/0002703 | A1 | 6/2001 | Koyama | |
| 2001/0045565 | A1 | 11/2001 | Yamazaki | |
| 2002/0011973 | A1 | 1/2002 | Komiya | |
| 2002/0044208 | A1 | 4/2002 | Yamazaki et al. | |
| 2002/0047120 | A1 * | 4/2002 | Inukai | 257/59 |
| 2002/0097212 | A1 | 7/2002 | Miyazawa et al. | |
| 2002/0158666 | A1 | 10/2002 | Azami et al. | |
| 2002/0167026 | A1 | 11/2002 | Azami et al. | |
| 2002/0190326 | A1 | 12/2002 | Nagao et al. | |
| 2003/0020520 | A1 | 1/2003 | Miyake et al. | |
| 2003/0034806 | A1 | 2/2003 | Azami | |
| 2003/0052324 | A1 | 3/2003 | Kimura | |
| 2003/0111677 | A1 | 6/2003 | Miyake | |
| 2006/0033161 | A1 | 2/2006 | Koyama | |

FOREIGN PATENT DOCUMENTS

| | | |
|---|---|---|
| EP | 1 063 630 | 12/2000 |
| EP | 1 102 234 | 5/2001 |
| EP | 1 107 220 | 6/2001 |
| EP | 1 139 326 | 10/2001 |
| JP | 55-156427 | 12/1980 |
| JP | 59-016424 | 1/1984 |
| JP | 60-140924 | 7/1985 |
| JP | 63-204815 | 8/1988 |
| JP | 03-165171 | 7/1991 |
| JP | 06-098081 | 4/1994 |
| JP | 09-186312 | 7/1997 |
| JP | 09-246936 | 9/1997 |
| JP | 10-319872 | 12/1998 |
| JP | 2000-106617 | 4/2000 |
| JP | 2000-221903 | 8/2000 |
| JP | 2000-347621 | 12/2000 |
| JP | 2001-005426 | 1/2001 |
| JP | 2001-109394 | 4/2001 |
| JP | 2001-133431 | 5/2001 |
| JP | 2002-176162 | 6/2002 |
| JP | 2002-251164 | 9/2002 |
| KR | 2001-20114 | 3/2001 |
| KR | 2001-51698 | 6/2001 |
| WO | 98/48403 | 10/1998 |
| WO | 01/20591 | 3/2001 |

OTHER PUBLICATIONS

Foreign Communication in Singapore Application No. 200204339-6 and Australian Patent Office Search Report, Feb. 25, 2004, 5 pages.
Foreign Communication in Singapore Application No. 200202969-2 dated Jun. 25, 2004 along with Australian Search Report (8 pages).
Office Action (U.S. Appl. No. 10/127,600), Oct. 22, 2004, 12 pages.
John Wiley & Sons; S.M. Sze, "Physics of Semiconductor Devices", 2nd Edition; pp. 27-30 (1981).
Search Report (Application No. 200508620-2; SG5840/5967D1), Dated Oct. 24, 2008.

* cited by examiner

LIGHT EMITTING DEVICE

CROSS-REFERENCE TO RELATED APPLICATIONS

This application is a divisional application of U.S. application Ser. No. 10/198,753, filed Jul. 16, 2002, now U.S. Pat. No. 6,958,750, and claims the benefit of foreign priority applications filed in Japan as Ser. No. 2001-216029 on Jul. 16, 2001 and as Ser. No. 2001-283998 on Sep. 18, 2001. This application claims priority to each of these prior applications, and the disclosures of the prior applications are considered part of (and are incorporated by reference in) the disclosure of this application.

BACKGROUND OF THE INVENTION

1. Field of the Invention

The present invention relates to a light emitting device. In particular, the present invention relates to a structure of an active matrix light emitting device having thin film transistors (hereafter referred to as TFTs) manufactured on an insulator such as glass or plastic. The present invention also relates to an electronic equipment using the light emitting device in its display portion.

2. Description of the Related Art

The development of display devices in which self light emitting elements such as electro luminescence (EL) elements are used, has been active recently. The term EL element includes either of an element that utilizes luminescence from a singlet exciton (fluorescence), and an element that utilizes luminescence from a triplet exciton (phosphorescence). An EL display device is given as an example of a light emitting device here, but display devices using other self light emitting elements are also included in the category of the light emitting device.

EL elements are composed of a light emitting layer sandwiched between a pair of electrodes (anode and cathode), normally a laminate structures. The laminate structure proposed by Tang et al. of Eastman Kodak Co. and having a hole transporting layer, a light emitting layer, and an electron transporting layer can be typically given. This structure has extremely high luminous efficiency, and this structure is applied to most EL elements that have been researched at present.

Further, other structures also exist, such as one in which a hole injecting layer, a hole transporting layer, a light emitting layer, and an electron transporting layer are laminated in sequence on an anode, and one in which a hole injecting layer, a hole transporting layer, a light emitting layer, an electron transporting layer, and an electron injecting layer are laminated in sequence on an anode. Any of these structures may be adopted as an EL element structure in the present invention. Doping of fluorescent pigments or the like to the light emitting layer may also be performed.

All layers formed between an anode and a cathode are generically referred to as EL layers here. The aforementioned hole injecting layer, hole transporting layer, light emitting layer, electron transporting layer, and electron injecting layer are therefore all included in EL layers. A light emitting element structured by an anode, an EL layer, and a cathode is referred to as an EL element.

A schematic diagram of a light emitting device is shown in FIG. 3A. A pixel portion 301 is disposed in a center portion of a substrate 300. A source signal line driver circuit 302 for controlling source signal lines, and gate signal line driver circuits 303 for driving gate signal lines are disposed in the periphery of the pixel portion 301. The gate signal line driver circuits 303 are arranged symmetrically on both sides of the pixel portion 301 in FIG. 3A, but one of them may be placed on only one side. However, considering factors such as reliability and efficiency of circuit operation, it is preferable to dispose the gate signal line driver circuits 303 on both the sides.

Signals such as a clock signal, a start pulse, and an image signal are input to the source signal line driver circuit 302 and the gate signal line driver circuits 303 through a flexible printed circuit (FPC) or the like.

Operation of the driver circuits is explained. In the gate signal line driver circuit, pulses for selecting the gate signal lines are output one after another by a shift register 321 in accordance with the clock signal and the start pulse. Then, the voltage amplitude of the signals are transformed by a level shifter 322, and are output to the gate signal lines via a buffer 323, and a certain one row of the gate signal lines is placed in a selected state.

In the source signal line driver circuit, sampling pulses are output one after another by a shift register 311 in accordance with the clock signal and the start pulses. In a first latch circuit 312, storage of a digital image signal is performed in accordance with the timing of the sampling pulse. When operation for one horizontal period portion is completed, a latch pulse is input during a return period, and the digital image signals of one row portion stored in the first latch circuit 312 are transferred all at once to a second latch circuit 313. The digital image signals of one row portion are then written simultaneously to pixels of the row to which the pulse for selecting the gate signal line is output.

The pixel portion 301 is explained next. A portion shown by reference numeral 310 in the pixel portion 301 corresponds to one pixel, and the circuit structure of the pixel is shown in FIG. 3B. Reference numeral 351 in FIG. 3B denotes a TFT that functions as a switching element (hereafter referred to as a switching TFT) during writing of the image signal to the pixel. A TFT having either n-channel polarity or p-channel polarity may be used as the switching TFT 351. Reference numeral 352 denotes a TFT (hereafter referred to as a driver TFT) which functions as an element for controlling electric current supplied to an EL element 354. If the driver TFT 352 is an n-channel TFT, then one electrode 355 of the EL element 354 is taken as a cathode, and is connected to an output electrode of the driver TFT 352. The other electrode 356 of the EL element 354 therefore becomes an anode. On the other hand, if a p-channel TFT is used as the driver TFT 352, then the one electrode 355 of the EL element 354 is taken as an anode, and is connected to the output electrode of the driver TFT 352. The other electrode 356 of the EL element 354 therefore becomes a cathode. Reference numeral 353 denotes a storage capacitor (Cs) formed in order to store the electric potential applied to a gate electrode of the driver TFT 352. Although the storage capacitor (Cs) is shown here as an independent capacitive means, a capacitance that occurs between the gate electrode and a source region of the driver TFT 352, or a capacitance that occurs between the gate electrode and a drain region of the driver TFT 352 may also be utilized.

A simple explanation is given for the relationship between the polarity of the driver TFT 352 and the structure of the EL element 354, with reference to FIGS. 5A and 5B. FIG. 5A shows the structure of a pixel portion of an EL element, and FIG. 5B shows schematically the connections among a switching TFT 501, a driver TFT 502, and an EL element 504.

Further, TFT operation is discussed when explaining circuit operation in this specification. The term "TFT turns on"

indicates that the absolute value of the voltage between a gate and a source of a TFT exceeds the absolute value of the TFT threshold voltage, and a source region and a drain region of the TFT are thus placed in a conductive state through a channel forming region. The term "TFT turns off" indicates that the absolute value of the voltage between the gate and the source of the TFT is lower than the absolute value of the TFT threshold voltage, and the source region and the drain region of the TFT are in a non-conductive state.

In addition, the terms "gate electrode, input electrode, output electrode" and gate electrode, source electrode, drain electrode" are used separately when explaining TFT connections. This is because the voltage between the gate and the source is often considered when explaining TFT operation, but it is difficult to clearly differentiate between the source region and the drain region of the TFT on a structural level. Therefore the two regions are referred to as the input electrode and the output electrode when explaining signal input and output, and one of the input electrode and the output electrode is referred to as the source region, while the other is referred to as the drain region, when explaining the relationship between the electric potentials of the TFT electrodes.

First, consider a case in which reference numeral 505 denotes an anode, and reference numeral 506 denotes a cathode in the EL element 504. If the electric potential of the electrode 505 is taken as $V_{505}$ and the electric potential of the electrode 506 is taken as $V_{506}$, then it is necessary to impart a forward bias between the anode and the cathode in order that the EL element 504 emits light. Therefore $V_{505}>V_{506}$ is satisfied. In order to turn on the driver TFT 502 with certainty if it is an n-channel TFT, and normally apply voltage between the electrodes of the EL element 504, it is necessary that the electric potential applied to the gate electrode of the driver TFT 502 be greater than $V_{505}$ by at least the amount of the threshold value of the TFT 502. That is, it is necessary to expand the amplitude of a signal written in from a source signal line. On the other hand, it is necessary for the electric potential applied to the gate electrode of the driver TFT 502 be less than $V_{505}$ by at least the amount of the threshold value of the TFT 502 in order to turn on the driver TFT 502 with certainty if it is a p-channel TFT and normally apply voltage between the electrodes of the EL element 504. It is therefore not necessary to expand the amplitude of the signal written in from the source signal line large amount. It is thus preferable to use a p-channel TFT for the driver TFT 502 for cases in which the electrode 505 is the anode, and the electrode 506 is the cathode in the EL element 504.

Further, if the driver TFT 502 is n-channel in this case, then a voltage $V_{GS2}$ between the gate and the source of the driver TFT 502 becomes the voltage between the gate electrode of the driver TFT 502 and the anode 505 of the EL element 504, not that shown in FIG. 5B. If the resistance rises, increasing $V_{EL}$, due to defects in the characteristics of the EL element 502 at this time, or due to long term degradation, then the electric potential of a source electrode of the driver TFT 502 increases. There is a possibility that the voltage between the gate and the source of the driver TFT 502 will cause dispersion to develop between pixels due to dispersion in EL elements 504. It is therefore preferable to use a p-channel TFT as the driver TFT 502 here.

In order to make the EL element 504 emit light when reference numeral 505 denotes the cathode, and reference numeral 506 denotes the anode in the EL element 504, it is necessary to impart an electric potential difference between both the electrodes. In this case, $V_{505}<V_{506}$ is satisfied. In order to turn on the driver TFT 502 with certainty if it is an n-channel TFT, and normally apply voltage between the electrodes of the EL element 504, the electric potential applied to the gate electrode of the driver TFT 502 is sufficiently greater than $V_{505}$ by at least the amount of the threshold value of the TFT 502. It is therefore not necessary to expand the amplitude of the signal written in from the source signal line be a large amount. On the other hand, it is necessary for the electric potential applied to the gate electrode of the driver TFT 502 be made less than $V_{505}$ by at least the amount of the threshold value of the TFT 502 in order to turn on the driver TFT 502 with certainty if it is a p-channel TFT and normally apply voltage between the electrodes of the EL element 504. That is, the amplitude of the signal written in from the source signal line must be expanded. It is thus preferable to use an n-channel TFT for the driver TFT 502 for cases in which the electrode 505 is the cathode, and the electrode 506 is the anode in the EL element 504.

Further, when considering the voltage between the gate and the source of the driver TFT 502, and the electric potential of the cathode of the EL element, it is also preferable to use a p-channel TFT for the driver TFT 502 in this case.

Next, the relationship between the direction of light emission to the polarity of the driver TFT 502 and the EL element 504 structure is discussed. FIG. 8A is a schematic cross sectional diagram of the structure of the EL element 504 when the driver TFT 502 is an n-channel TFT, and FIG. 8B is a schematic cross sectional diagram of the structure of the EL element 504 when the driver TFT 502 is a p-channel TFT.

It is preferable to use a metallic material in the cathode of the EL element 504 because the ability to inject electrons into a light emitting layer is desired. The electrode that uses a transparent electrode is therefore normally the anode. The driver TFT in FIG. 8A is therefore an n-channel TFT, a current supply line is connected to the source region of the driver TFT 502 and the cathode of the EL element 504 is connected to the drain region of the driver TFT 502. Consequently, light generated by the light emitting layer is emitted toward the transparent electrode anode side, and therefore the direction of light emission is opposite to a substrate on which the TFT is formed (hereafter referred to as a TFT substrate), as shown in the figure.

On the other hand, in FIG. 8B the driver TFT 502 is a p-channel TFT. The current supply line is connected to the source region of the driver TFT 502, and the anode of the EL element 504 is connected to the drain region of the driver TFT 502. Consequently, light generated by the light emitting layer is emitted toward the transparent electrode anode side, and therefore the direction of light emission is toward the TFT substrate, as shown in the figure.

The light emission direction shown in FIG. 8A is referred to as upper surface emission, and the light emission direction shown in FIG. 8B is referred to as lower surface emission here. The region occupied by the elements structuring the pixel portion influences the light emission surface area in the lower surface emission case. On the other hand, in the upper surface emission case, light can be extracted with no relation to the region occupied by the elements structuring the pixel portion, and this is useful in increasing the aperture ratio. However, it is necessary to form the anode using the transparent electrode after EL layer formation with process considerations when manufacturing an upper surface emission structure light emitting device, as shown in FIG. 8A. Damage is easily imparted to the EL layer by this process, and this type of process is difficult to be done at present. The lower surface emission structure shown in FIG. 8B is therefore generally employed.

A method of driving a light emitting device is explained next.

An analog gradation method and a digital gradation method can be given as examples of methods of expressing many gradations using a light emitting device. The analog gradation method is one in which electric current flowing in EL elements is controlled in an analog manner, thus controlling brightness, and gradations are obtained. However, minute dispersions in the characteristics of TFTs structuring a pixel portion have a large influence on dispersions in EL brightness. Namely, if there is dispersion in the characteristics of the driver TFT 102, then the amount of electric current flowing between a source and a drain of different driver TFTs will differ, even if the same electric potential is imparted to gate electrodes of the driver TFTs. In other words, dispersion in brightness develops due to the different amount of electric current flowing in the EL elements.

The digital gradation method is a method in which dispersion in the characteristics of the elements structuring the pixels does not easily influence image quality. The EL elements are driven by using only two states, an on state (a state in which the brightness is near 100%), and an off state (a state in which the brightness is nearly 0%). That is, it can be said that the digital gradation method is a driving method in which dispersion in the brightness of the EL elements is difficult to be distinguished even if there are dispersions in the amount of electric current flowing between the source and the drain of the driver TFTs.

However, only two gradations can be displayed with the digital gradation method in this state, and a plurality of techniques for achieving many gradations by combining the digital gradation method with another method have been proposed.

One method that can be given for achieving multiple gradations is a combination of the digital gradation method with a time gradation method. The term time gradation method denotes a method in which gradation expression is performed by controlling the amount of time during which the EL elements emit light. Specifically, one frame period is divided into a plurality of subframe periods of different lengths. Gradations are expressed by selecting whether or not the EL elements emit light during each subframe period, thus using the difference in length of time for light emission within one frame period.

The method disclosed in Japanese Patent Application Laid-open No. 2001-5426 is discussed here as one method of combining the digital gradation method with the time gradation method. A case of 3-bit gradation expression is explained here as an example.

Refer to FIGS. 9A to 9C. The frame frequency used in display devices such as liquid crystal displays and EL displays is normally on the order of 60 Hz. That is, screen drawing is performed on the order of 60 times per second, as shown in FIG. 9A. It is thus possible to perform display such that the human eye does not experience screen flicker. A period for performing screen drawing one time is referred to as one frame period here.

One frame period is divided into a plurality of subframe periods in a time gradation method disclosed in Japanese Patent Application Laid-open No. 2001-5426. The number of divisions at this point is equal to the number of gradation bits. Namely, one frame period is divided into three subframe periods SF1 to SF3 here because a 3-bit gradation is used.

In addition, each subframe period has an address (writing) period Ta and a sustain (light emission) period Ts. The address (writing) periods are periods for writing a digital image signal into pixels, and each subframe period has equal length. The sustain periods are periods during which the EL elements emit light based on the digital image signal written into the pixels during the address (writing) periods. Sustain (light emission) periods Ts1 to Ts3 have a length ratio that satisfies Ts1:Ts2:Ts3=4:2:1. That is, for n-bit gradation expression, n sustain (light emission) periods have a length ratio of $2^{n-1}:2^{n-2}:\ldots:2^1:2^0$. The length of the period for each pixel to emit light during one frame period is determined by the specific sustain (light emission) period during which the EL element emits light. Gradation expression is thus performed. In other words, by taking a light emitting state or a non-light emitting state for the sustain (light emission) periods Ts1 to Ts3 in FIG. 9B, and utilizing the length of the total light emission time, 8 gradations having brightnesses of 0%, 14%, 28%, 43%, 57%, 71%, 86%, and 100% can be expressed. The brightness is 57% if there is light emission during Ts1 and no light emission during Ts2 and Ts3, and while the brightness is 71%, light emission occurs during Ts1 and Ts3 but not during Ts2. To obtain a 71% brightness by an analog gradation method, control is performed by using a voltage corresponding to 71% brightness, and the 71% brightness is maintained over the entire one frame period. With the time gradation method, however, the same gradation is expressed by emitting light at 100% brightness for only 71% of the entire light emission period.

Operation is explained in detail. Continue to refer to FIGS. 9A to 9C, as well as FIG. 3B. First, the switching TFT 351 turns on when a selection pulse is input to a gate signal line. A digital image signal is input next from a source signal line, and control for whether the driver TFT 352 turns on or off is performed in accordance with the electric potential of the digital image signal. In addition, electric charge corresponding to the digital image signal is stored in the storage capacitor 353. Even if the driver TFT 352 turns on at this point, voltage is not applied between the anode (cathode) 355 and the cathode (anode) 356, and therefore light is not emitted. One such method is to set the electric potential of the cathode (anode) 356 equal to the electric potential of the anode (cathode) 355, namely to the electric potential of a current supply line (current). The cathode (anode) 356 is normally common across all pixels, and therefore this operation is performed simultaneously for all pixels.

At the point where writing operations are finished from a first row until a final row, the address (writing) period is complete, and all of the pixels move simultaneously into the sustain (light emission) period. Voltage is applied between the anode (cathode) 355 and the cathode (anode) 356 of the EL element 354, and electric current flows, causing light to be emitted.

One frame period is structured by performing the aforementioned operations over all of the subframe periods. To increase the number of display gradations with this method, the number of subframe periods may be increased. Further, it is not always necessary for the subframe periods to appear in order from the uppermost bit to the lowermost bit as shown in FIGS. 9B and 9C, and the subframe periods may be arranged randomly within the frame period. In addition, the order may also be changed within each frame period. This type of driving method is referred to as display period separated driving (DPS driving).

A lowered duty ratio (the period for performing gradation display, in which the pixels emit light, per frame period) can be given as one problem with DPS driving. The address (writing) period and the sustain (light emission) period are separated, and therefore periods exist within one frame period during which light is not emitted under any conditions. As a result, an overall drop in brightness can be perceived.

In a certain subframe period for pixels connected to a number m row gate signal line, writing of a digital image signal to the pixels is performed in a period 902 during which a gate signal line is selected, as shown in FIG. 9D, and light is emitted in a sustain (light emission) period 904. An address (writing) period is the total of periods denoted by reference numerals 901, 902, and 903 here. Reference numeral 901 denotes a period for performing writing of a digital image signal to the number 1 to the number (m−1) row, while reference numeral 903 denotes a period for performing writing of the digital image signal to the number (m+1) row to the final row. In other words, for the pixels connected to the number m row gate signal line, the periods denoted by reference numerals 901 and 903 in the address (writing) period become periods during which both writing and light emission are not performed, namely, "waiting" periods.

Address (writing) periods are formed in each of the subframe periods, and therefore the address (writing) periods also increase if many gradation levels are sought. There is also an increase in the aforementioned "waiting" periods, and this invites a further reduction in the duty ratio.

A method for solving these types of problems is given here. This method is one in which there is no separation between the address (writing) periods and the sustain (light emission) periods, as shown in FIG. 9E, and light emission begins immediately after writing of a digital image signal to pixels connected to a certain row gate signal line is complete. The pixels connected to the number m row gate signal line can be made to emit light also during the periods for performing writing of the digital image signal to the pixels connected to gate signal lines other than the number m row gate signal line, as shown in FIG. 9F, and therefore the problem of the reduction in the duty ratio can be solved with this method.

However, other problems develop with this method when considering the increase in the number of gradations.

FIGS. 10A and 10B are examples of dividing one frame period for a case of expressing 5-bit gradations by the above-mentioned DPS driving. The address (writing) periods increase accompanied with the increase in the number of divisions of the subframe periods, and the sustain periods are shorter compared to the 3-bit gradation case. It thus can be understood that the duty ratio is lower compared to the 3-bit gradation case. On the other hand, as shown in FIG. 10C, cases in which the duty ratio reduction is prevented by driving in accordance with a method in which the address (writing) periods and the sustain (light emission) periods are not separated are considered. The length ratio between sustain periods Ts1 to Ts5 of the respective subframe periods is Ts1:Ts2:Ts3:Ts4:Ts5=$2^4$:$2^3$:$2^2$:$2^1$:$2^0$=16:8:4:2:1.

Refer to FIG. 10B and focus on reference symbol SF5. It can be seen that the sustain (light emission) period is longer than the address (writing) period in SF5. Periods in which the address (writing) periods of different subframe periods overlap therefore develop for cases of driving in accordance with a driving method in which there is no separation between the address (writing) period and the sustain (light emission) period. Before writing to the final row is complete in SF5 in FIG. 10C, the sustain (light emission) period of the number 1 row has finished, and the next writing has started. In other words, the gate signal lines of two different rows are selected at the same time, and normal signal writing cannot be performed.

A display device shown in FIGS. 4A and 4B has been proposed in Japanese Patent Application No. 2000-86968 in order to solve this type of problem. The display device shown in FIG. 4A is nearly the same as the display device shown previously in FIG. 3A. The difference between the two is that the display device of FIG. 4A has a writing gate signal line driver circuit 403 and an erasure gate signal line driver circuit 404 on the left and right of a pixel portion 401.

The circuit structure of one pixel, denoted by reference numeral 410 in the display device of FIG. 4A, is shown in FIG. 4B. This structure differs from the pixel shown in FIG. 3B in that it has an erasure gate signal line and an erasure TFT 457.

The aforementioned problem in that different address (writing) period overlap is solved by using this type of display device.

An explanation is given regarding its operation. Refer to FIG. 4B and to FIGS. 10A to 10D for the explanation. First, a writing gate signal line is selected, and a switching TFT 451 turns on. A digital image signal is then input from a source signal line, a driver TFT 452 is controlled to turn on or off by the electric potential of the input signal, and in addition, an electric charge corresponding to the input signal is stored in a storage capacitor 453. Rows to which writing of the digital image signal is complete then move immediately to the sustain (light emission) period.

As shown in FIGS. 10C and 10D, an erasure period (Tr5) is formed after completion of the sustain (light emission) period for subframe periods having shorter sustain (light emission) periods than address (writing) periods. This is done so that the next address period does not begin immediately after the sustain (light emission) period. An EL element 454 does not emit light during the erasure period. The erasure TFT 457 turns on by the selection of the erasure gate signal line, releasing the electric charge stored in the storage capacitor 453, in the erasure period (Tr5). The electric current flowing in the driver TFT 452 thus stops, and the EL element 454 stops emitting light.

The length of the erasure period at this point becomes the length from after the address (writing) period for the number 1 row is complete until the address (writing) period for the final row is complete.

Multiple gradations are thus achieved by forming the erasure period to increase the duty ratio, and by preventing incorrect overlap of the address (writing) periods. In contrast to the DPS driving, this type of driving method is referred to as simultaneous erasing scan driving (SES driving).

Strictly speaking, the SES driving includes the meaning that writing and erasure are performed in parallel. In contrast to the DPS driving in which the address (writing) period and the sustain (light emission) period are separated, driving methods having no such separation are referred to as SES driving. Cases in which there is no specific erasure period are thus also included in the SES driving methods, as shown in FIGS. 9E and 9F.

The fact that manufacturing processes are complex for display devices manufactured by forming TFTs on an insulator invites a reduction in throughput and an increase in cost. The main challenge in reducing cost is therefore that process is simplified as much as possible. Structuring a pixel portion and peripheral driver circuits (such as a source signal line driver circuit and a gate signal line driver circuit) by using only TFTs of the same conductivity type is thus considered.

The operating voltages of the pixels and the driver circuits are once again considered. Refer again to FIGS. 5A and 5B. FIG. 5A shows the structure of an EL element pixel portion, and a schematic expression of connections among the switching TFT 501, the driver TFT 502 and the EL element 504 is shown in FIG. 5B.

If the driver TFT 502 is a p-channel TFT, then as discussed above, it is preferable that the electrode 505 of the EL element is the anode, and that the electrode 506 is the cathode. The polarity of the switching TFT 501 is considered with respect to the polarity of the driver TFT 502 here. First, for cases in which the driver TFT 502 is a p-channel TFT, the condition for the driver TFT 502 to turn on is that the absolute value of the gate-source voltage $V_{GS2}$ of the driver TFT 502 is greater than the absolute value of the threshold voltage of the driver TFT 502. That is, the L level of the digital image signal input from the source signal line (the EL element is assumed to emit light when the electric potential of the digital image signal is L level here) is lower than the electric potential of the source region of the driver TFT 502 by more than the threshold value.

If the switching TFT 501 and the driver TFT 502 have the same polarity at this point, namely if they are both p-channel type, then the condition for the switching TFT 501 to turn on is that the absolute value of the gate-source voltage $V_{GS1}$ of the switching TFT 501 is greater than the absolute value of the threshold voltage of the switching TFT 501. That is, the L level of a pulse that places the gate signal line in a selected state (the gate signal line is taken as being in a selected state when L level is input to the gate signal line because the switching TFT 501 is p-channel type here) is lower than the electric potential of the source region of the switching TFT 501 by more than the threshold value. It is therefore necessary for the voltage amplitude of the gate signal line side to be expanded with respect to the voltage amplitude of the source signal line. This means that the operating voltage of the gate signal line driver circuit is made higher.

Similar circumstances also exist if the switching TFT 501 and the driver TFT 502 are both n-channel TFTs. It therefore becomes preferable to use both n-channel and p-channel TFTs for the pixel portion TFTs when considering electric power consumption.

From the above discussion, although structuring the pixel portion and the driver circuits by TFTs of the same conductivity type in accordance with a conventional method achieves a reduction in the number of processes, it also invites an increase in electric power consumption.

SUMMARY OF THE INVENTION

In view of the aforementioned problems, an object of the present invention is to provide a light emitting device in which the number of processes is reduced by structuring a pixel portion and driver circuits by TFTs of the same conductivity type, and in which a reduction in electric power consumption is achieved by using a novel circuit structure.

In a conventionally structured pixel, it is necessary that signals input to a gate electrode of a switching TFT, namely signals for selecting a gate signal line, have a larger voltage amplitude than signals input to a source region of the switching TFT, namely signals output to a source signal line.

A case in which the voltage amplitude of the signal output to the source signal line is equal to the voltage amplitude of the signal for selecting the gate signal line is considered. Refer again to FIGS. 5A and 5B.

If signals possessing a certain electric potential are input from the source signal line when the voltage amplitude of signals output to the source signal line is equal to the voltage amplitude of signals for selecting the gate signal line, then the electric potential of the gate electrode of the driver TFT 502 will rise to the electric potential in which the electric potential of the threshold value of the switching TFT 501 is subtracted from the electric potential of the signal input from the source signal line. The electric potential of the gate electrode of the driver TFT 502 will therefore become an electric potential that is lower than the voltage amplitude of the input signal by the amount of the threshold value of the switching TFT.

In the present invention, a voltage compensation circuit is formed between the output electrode of the switching TFT and the gate electrode of the driver TFT. The voltage compensation circuit corresponds to a bootstrap circuit, and functions to return the voltage amplitude of the signal, damped by passing through the switching TFT, to its normal amplitude. It is thus possible for the pixel to operate normally, even in cases in which the voltage amplitude of the signals output from the source signal line is made equal to the voltage amplitude of the signals for selecting the gate signal line. It therefore becomes possible to decrease the driver voltage of the gate signal line driver circuit, and this contributes to reducing the electric power consumption of the display device.

The above-stated problems are solved by structuring the pixel portion of the display device using pixels having the voltage compensation circuit of the present invention, and by structuring the driver circuits in the periphery of the pixel portion using TFTs having the same polarity as the TFTs constituting the pixel portion.

DETAILED DESCRIPTION OF THE PREFERRED EMBODIMENTS

Embodiment Mode 1

Figure 1A:
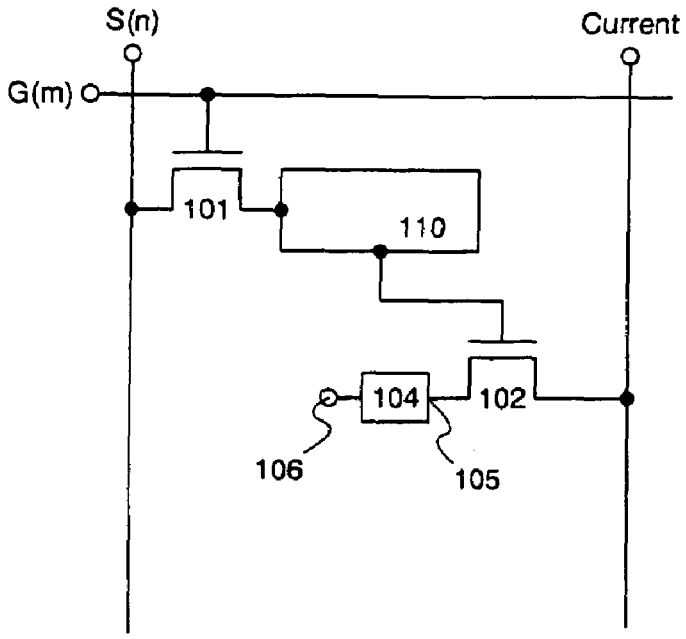
FIGS. 1A and 1B are diagrams showing an embodiment mode of the present invention.
Figure 1B:
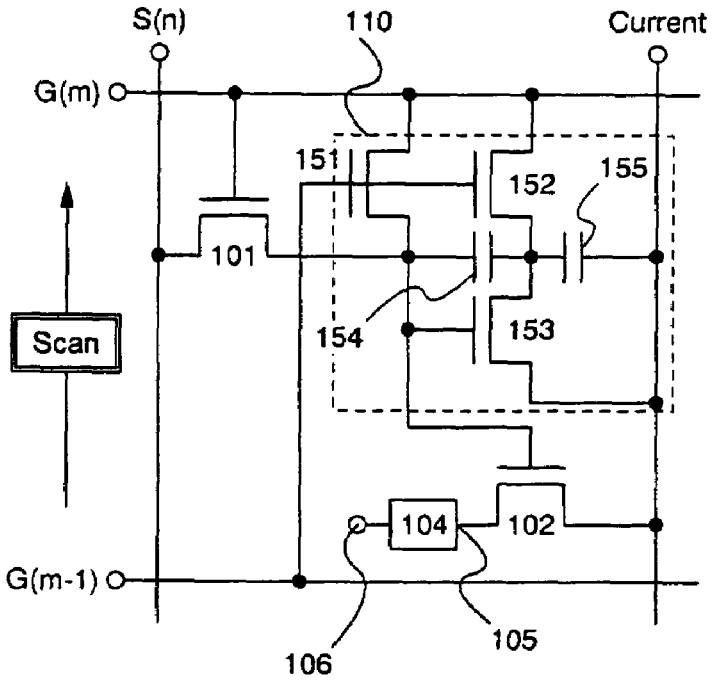

The structure of a pixel of a voltage compensation circuit of the present invention is shown in FIGS. 1A and 1B. As shown in FIG. 1A, components similar to conventional components are used for a switching TFT 101, a driver TFT 102, an EL element 104, a source signal line (S), a gate signal line (G), and a current supply line (current). The pixel of the present invention has a voltage compensation circuit 110 between an output electrode of the switching TFT 101 and a gate electrode of the driver TFT 102.

FIG. 1B is a circuit diagram including the structure of the voltage compensation circuit 110. The voltage compensation circuit 110 has a first TFT 151, a second TFT 152, a third TFT 153, a first capacitor 154, and a second capacitor 155. Further, reference symbol G(m) denotes a gate signal line scanned in a number m row, and reference symbol G(m−1) denotes a gate signal line scanned by a number (m−1) row.

The first capacitor 154 and the second capacitor 155 are arranged in series. A first electrode of the first capacitor 154 is connected to the output electrode of the switching TFT 101, and a second electrode of the first capacitor 154 is connected to a first electrode of the second capacitor 155. A second electrode of the second capacitor 155 is connected to the current supply line.

A gate electrode of the first TFT 151 is connected to the gate signal line G(m−1), an input electrode of the first TFT 151 is connected to the gate signal line G(m), and an output electrode of the first TFT 151 is connected to the output electrode of the switching TFT 101.

A gate electrode of the second TFT 152 is connected to the gate signal line G(m−1), and an input electrode of the second TFT 152 is connected to the gate signal line G(m). An output electrode of the second TFT 152 is connected to the second electrode of the first capacitor 154, and to the first electrode of the second capacitor 155.

A gate electrode of the third TFT 153 is connected to the output electrode of the switching TFT 101, and an input electrode of the third TFT 153 is connected to the electric power source line. An output electrode of the third TFT 153 is connected to the second electrode of the first capacitor 154, and to the first electrode of the second capacitor 155.

Note that TFTs all having the same polarity are used here for the TFTs 101, 102, and 151 to 153 structuring the pixel. The polarity may be n-channel or p-channel type.

Circuit operation is explained next. An example in which the TFTs structuring the pixel are all n-channel TFTs is used here. The amplitude of input signals is set to VDD (H level)−VSS (L level) for signals input from the source signal line and for signals that select the gate signal line. In addition, as an initial state, the electric potential of the source signal line (S) and the electric potential of the gate signal line (G) are both set to VSS, and the electric potential of the current supply line (current) is set to VDD.

Figure 9A:
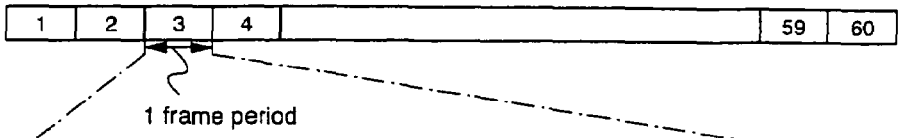
FIGS. 9A to 9F are diagrams showing timing charts relating to light emitting device driving.
Figure 9B:
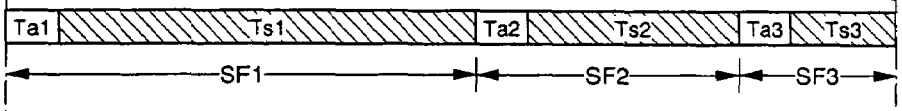
Figure 9C:
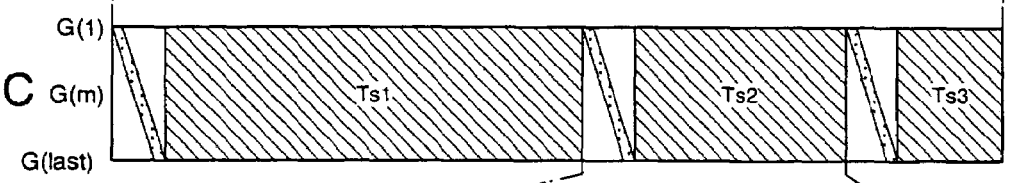
Figure 9D:
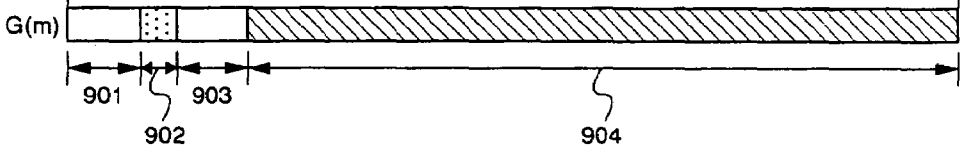
Figure 9E:
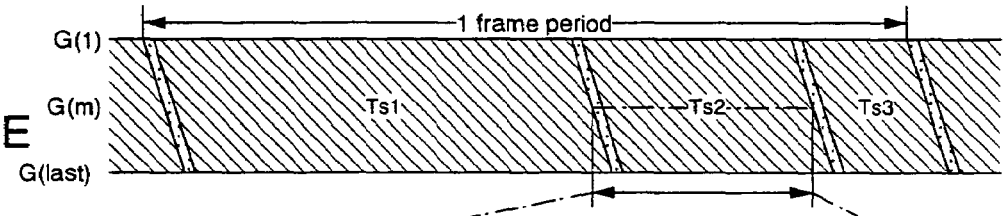
Figure 9F:
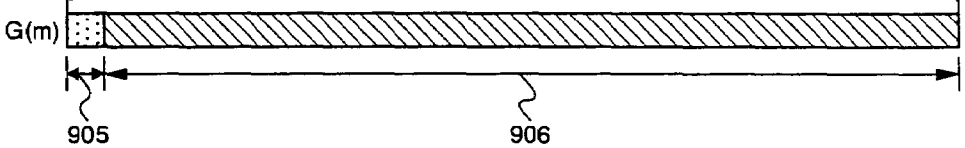
Figure 10A:
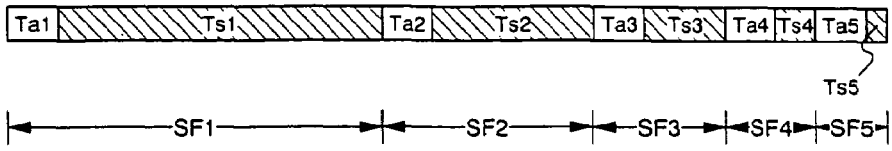
FIGS. 10A to 10D are diagrams showing timing charts relating to light emitting device driving.
Figure 10B:
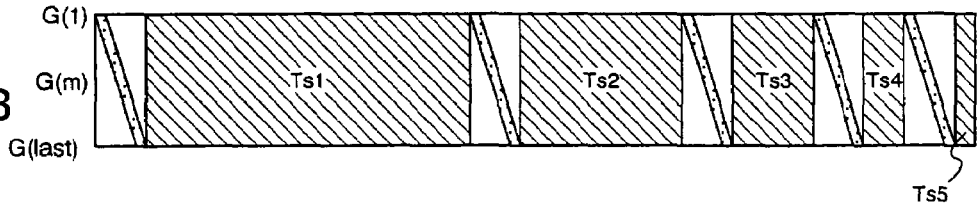
Figure 10C:
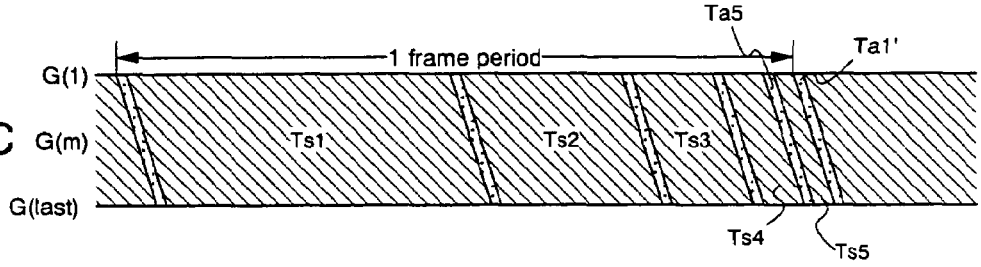
Figure 10D:
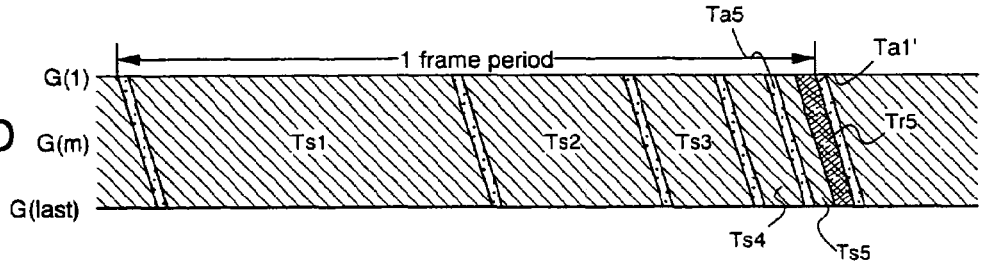
Figures 11A, 11B, 11C, 11D:
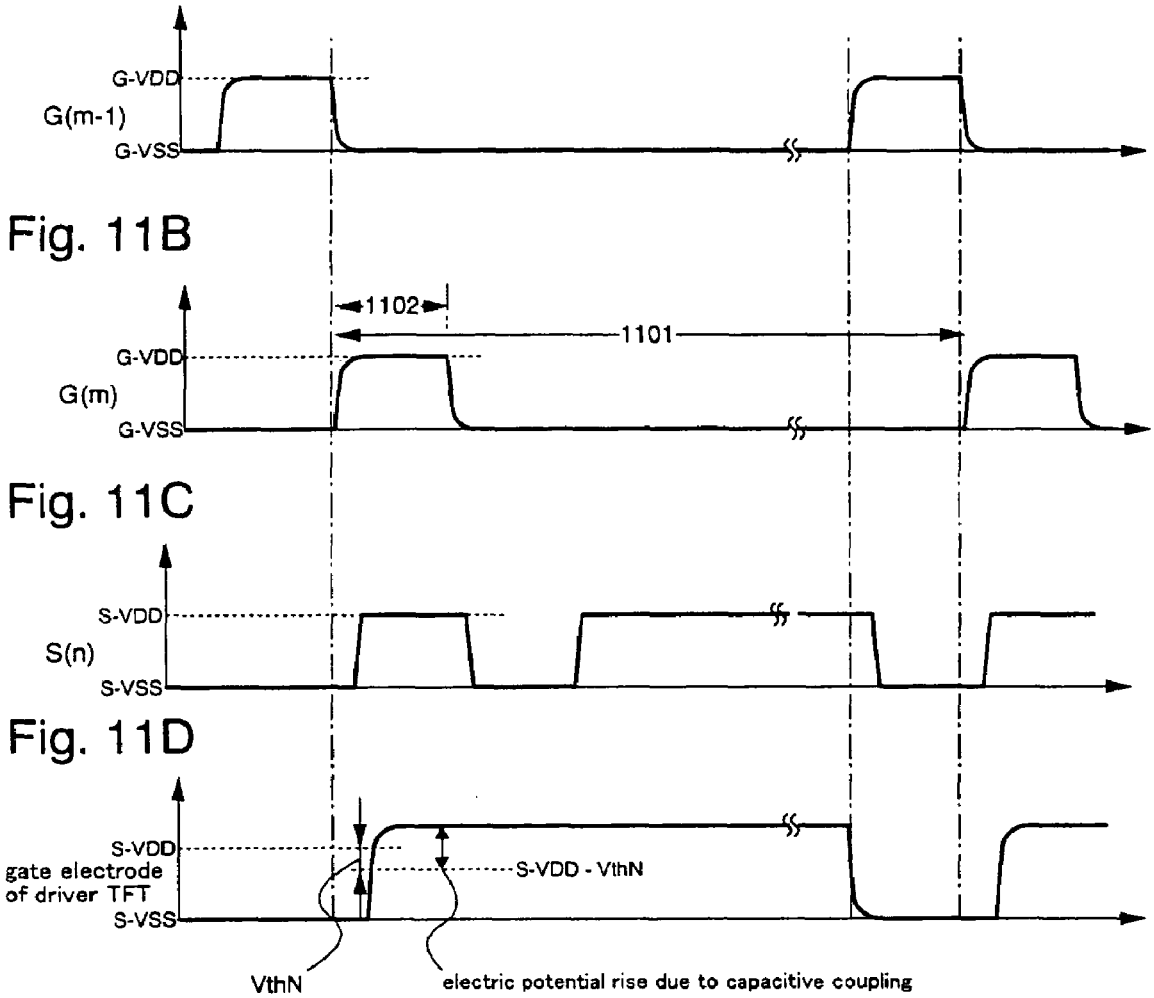
FIGS. 11A to 11D are diagrams showing the electric potential of each node at the time of driving a pixel of a light emitting device of the present invention.

Further, the threshold voltages of the TFTs are all taken as VthN. FIGS. 11A to 11D are timing charts for explaining the operation of the circuits of the present invention shown in FIGS. 1A and 1B. FIG. 11A shows the electric potential of the number (m−1) row gate signal line (G(m−1)), FIG. 11B shows the electric potential of the number m row gate signal line (G(m)), FIG. 11C shows the electric potential of a source signal line (S(n)), and FIG. 11D shows the electric potential of the gate electrode of the driver TFT 102. Further, a period 1101 from after the number m row gate signal line (G(m)) is selected, until the number m row gate signal line (G(m)) is selected again corresponds to a subframe period shown in FIG. 9F. A period denoted by reference numeral 1102 is one horizontal period. FIGS. 1A and 1B, and FIGS. 11A to 11D are used in the explanation of the operation.

The number (m−1) gate signal line (G(m−1)) is selected and becomes H level, and writing of a digital image signal to the number (m−1) row pixel is performed. At this point in the number m row of pixels, H level is input to the gate electrodes of the first TFT 151 and the second TFT 152, which then turn on. Both the electrodes of the first capacitor 154 become equal to the electric potential of the number m row gate signal line, namely VSS. At the same time, the electric potential of the gate electrode of the driver TFT 102 also becomes VSS.

The number (m−1) row gate signal line (G(m−1)) is then unselected, its electric potential becomes L level, and the first TFT 151 and the second TFT 152 are placed in an off state. The number m row gate signal line (G(m)) is selected and becomes H level, and the switching TFT 101 turns on. The electric potential of the source signal line (S(n)) at this point, namely the digital image signal, is input to the gate electrode of the driver TFT 102, which is turned on. The digital image signal is simultaneously input to the gate electrode of the third TFT 153, which turns on.

At the point where the electric potentials of the gate electrodes of the driver TFT 102 and the third TFT 153 become (VDD−VthN), the voltage between the gate and the source of the switching TFT 101 becomes equal to the threshold voltage VthN, and the switching TFT 101 is placed in an off state as a result. The gate electrode of the driver TFT 102 and the gate electrode of the third TFT 153 are therefore temporarily placed in a floating state.

On the other hand, the electric potential of the output electrode side of the third TFT 153 rises when the third TFT 153 turns on. A capacitive coupling exists at this point between the output electrode of the third TFT 153 and the gate electrode of the driver TFT 102 due to the first capacitor 154. The gate electrode of the driver TFT 102 is in a floating state, and therefore the electric potential of the gate electrode of the driver TFT 102 once again rises from (VDD−VthN), along with the rising electric potential of the output electrode of the third TFT 153, and becomes an electric potential higher than VDD.

As a result, the digital image signal attenuated once by VthN receives amplitude compensation by the voltage compensation circuit, through the switching TFT 101, and is applied to the gate electrode of the driver TFT 102. The driver TFT 102 is therefore normally turned on, and a desired drain current can be obtained.

The electric potential applied to the gate electrode of the driver TFT 102 is thereafter maintained by the capacitors 154 and 155, an electric current flows, and the EL element 104 emits light. In the next subframe period, the first TFT 151 and the second TFT 152 are placed in an on state when the number (m−1) gate signal line (G(m−1)) is selected. The electric potential of the gate electrode of the driver TFT 102 becomes equal to the electric potential of the number m row gate signal line (G(m)), namely L level.

A discussion of the first capacitor 154 and the second capacitor 155 is added here.

The first capacitor 154 is placed between the output electrode and the gate electrode of the third TFT 153. The first capacitor 154 is a capacitance that is used for increasing the electric potential of the gate electrode of the driver TFT 102 by utilizing capacitive coupling. The second capacitor 155 is arranged in series with the first capacitor 154, and capacitive coupling is formed between the electric current source supply line, having a stable electric potential, and the driver TFT 102. The second capacitor 155 is used for storing the electric potential of the gate electrode of the driver TFT 102.

An additional function of the second capacitor 155 is that it is used as a load for making the voltage compensation circuit bootstrap function properly. If this load is not present, then the electric potential of the output electrode of the third TFT 153 climbs immediately due to the capacitive coupling if the electric potential of the gate electrode of the third TFT 153 rises due to the input of the digital image signal from the source signal line. If this operation occurs, then the aforementioned bootstrap may not work properly. The electric potential rise of the output electrode of the third TFT 153, due to the capacitive coupling, is therefore delayed with respect to the rise in the electric potential of the gate electrode of the third TFT 153 by the placement of the second capacitor 155. The electric potential rise of the third TFT output electrode thus becomes managed by the drain current flowing at the time when the third TFT 153 itself is in an on state, and the bootstrap can work normally.

A gate signal line selection pulse normally requires a larger voltage amplitude than the voltage amplitude of the digital image signal input to the source signal line. In accordance with the above-stated method, it becomes possible to make the voltage amplitude of the gate signal line selection pulse equal to, or less than, that of the digital image signal. It therefore becomes possible to reduce the electric power consumption on the gate signal line driver circuit side.

Further, the electric potential of the gate electrode of the driver TFT 102, which rises due to the capacitive coupling, becomes higher than VDD in accordance with he present invention. This electric potential rises at least to VDD, and therefore it is possible to make the voltage amplitude of the gate signal line selection pulse even smaller by optimizing the values of the capacitors 154 and 155.

Note that it is preferable that the electric potential of the current supply line be kept high due to operating considerations for the case shown here, and therefore it is preferable that electrodes of the EL element 104 be such that reference numeral 105 denotes an anode, and that reference numeral 106 denotes a cathode. This case is the reverse of the conventional example already discussed. Lower surface light emission is provided for cases in which the structure uses n-channel TFTs, and upper surface light emission is provided for cases in which the structure uses p-channel TFTs.

Embodiment Mode 2

Figure 25A:
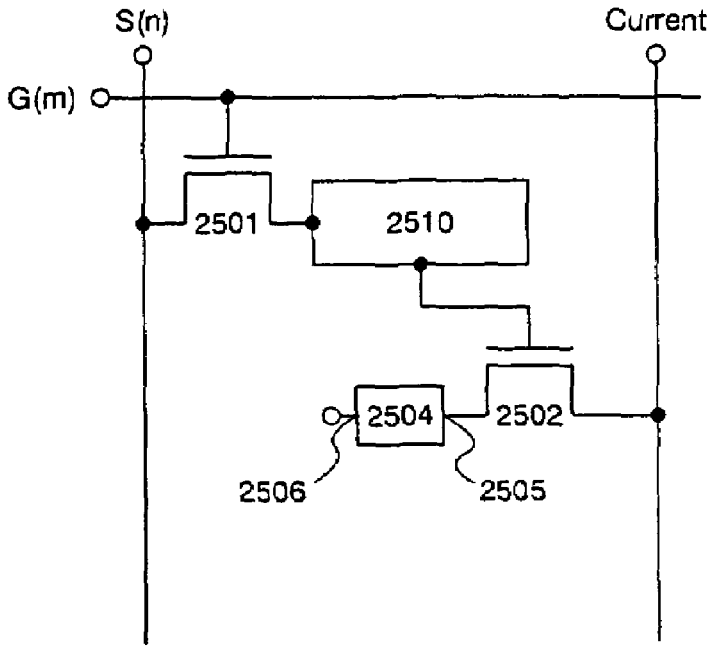
FIGS. 25A and 25B are diagrams showing an embodiment mode of the present invention.
Figure 25B:
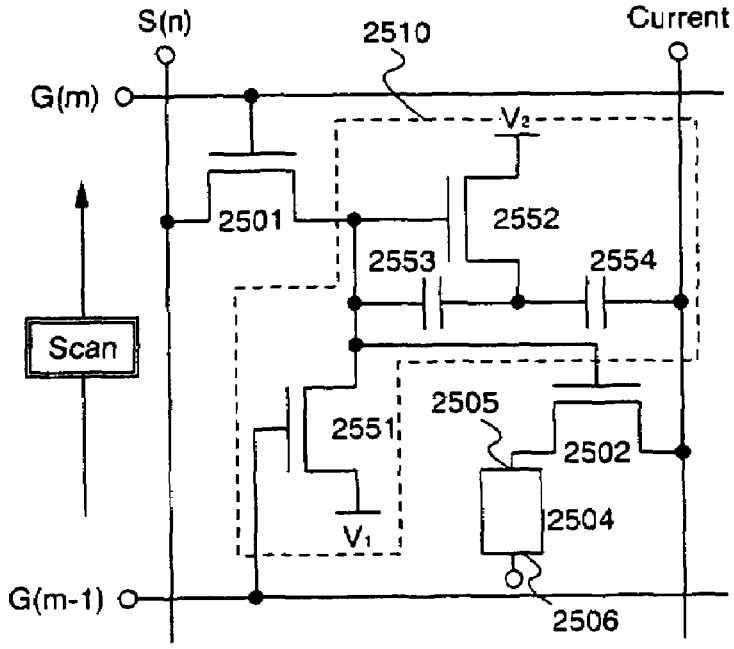

FIGS. 25A and 25B show a structure in which a portion differs from the structure of Embodiment Mode 1. As shown in FIG. 25A, components similar to conventional components are used for a switching TFT 2501, a driver TFT 2502, an EL element 2504, a voltage compensation circuit 2510, a source signal line (S(n)), a gate signal line (G(m)), and a current supply line (current).

FIG. 25B is a circuit diagram including the structure of the voltage compensation circuit 2510. The voltage compensation circuit 2510 has a first TFT 2551, a second TFT 2552, a first capacitive means 2553, and a second capacitive means 2554. The voltage compensation circuit is structured by three TFTs and two capacitors in Embodiment Mode 1, but in Embodiment Mode 2 the voltage compensation circuit 2510 is structured by two TFTs and two capacitors. Further, in FIG. 25B reference symbol G(m) denotes the gate signal line scanned in the number m row, and reference symbol G(m−1) denotes the gate signal line scanned by the (m−1) row.

The first capacitive means 2553 and the second capacitive means 2554 are arranged in series. A first electrode of the first capacitive means 2553 is connected to the output electrode of the switching TFT 2501, and a second electrode of the first capacitive means 2553 is connected to a first electrode of the second capacitive means 2554. A second electrode of the second capacitive means 2554 is connected to the current supply line.

A gate electrode of the first TFT 2551 is connected to the gate signal line G(m−1), and an input electrode of the first TFT 2551 is connected to a signal line that supplies a first power source electric potential ($V_1$), or to a power source line. An output electrode of the first TFT 2551 is connected to the output electrode of the switching TFT 2501.

A gate electrode of the second TFT 2552 is connected to the output electrode of the switching TFT 2501 and to the first electrode of the first capacitive means. An input electrode of the second TFT 2552 is connected to a signal line that supplies a second power source electric potential ($V_2$), or to a power source line, and an output electrode of the second TFT 2552 is connected to the second electrode of the first capacitive means and to the first electrode of the second capacitive means.

Regarding the two TFTs of voltage compensation circuit, the first TFT 2551 is hereafter referred to as a refresh TFT, and the second TFT 2552 is hereafter referred to as a compensation TFT.

Note that TFTs all having the same polarity are used here for the TFTs 2501, 2502, 2551, and 2552 structuring the pixel. The polarity may be n-channel or p-channel type.

However, the first power source electric potential ($V_1$) and the second power source electric potential ($V_2$) each differ in accordance with the polarity of the TFTs structuring the pixel. If the TFTs structuring the pixel are n-channel TFTs, then $V_1<V_2$ and if the TFTs structuring the pixel are p-channel TFTs, then $V_1>V_2$.

If $V_1<V_2$, the electric potential of $V_1$ is set to an electric potential sufficiently lower than the threshold voltage of n-channel TFTs, and the electric potential of $V_2$ is set to an electric potential sufficiently higher than the threshold voltage of the n-channel TFTs. For example, the electric potential of $V_1$ is set on the order of the L level of the signal line, and the electric potential of $V_2$ is set on the order of the H level of the signal line. The electric potentials may be reversed for cases in which $V_1>V_2$.

Circuit operation is explained next. An example in which the TFTs structuring the pixel are all n-channel TFTs is used here. Input signals, either digital image signals output to the source signal line or signals for selecting the gate signal line, are set to VDD for H level, and are set to VSS for L level. Further, $V_1$=VSS and $V_2$=VDD here. In addition, the electric potential of the current supply line (current) is set to $V_C$.

Drive timing is mostly similar to that used in Embodiment Mode 1, and therefore FIGS. 11A to 11D are used. FIG. 11A shows the electric potential of the number (m−1) row gate signal line (G(m−1)), FIG. 11B shows the electric potential of the number m row gate signal line (G(m)), FIG. 11C shows the electric potential of a source signal line (S(n)), and FIG. 11D shows the electric potential of the gate electrode of the driver TFT 2502. Further, a period 1101 from after the number m row gate signal line (G(m)) is selected, until the number m row gate signal line (G(m)) is selected again corresponds to a subframe period (SF#) shown in FIG. 9B. A period denoted by reference numeral 1102 is one horizontal period. A pixel in which the switching TFT 2501 is controlled by the gate signal line selected in the number m row is explained using FIGS. 1A and 1B, and FIGS. 11A to 11D.

First, during a period in which the number (m−1) row gate signal line (G(m−1)) is selected, namely a period during which writing of an image signal to the number (m−1) row is performed, the number (m−1) row gate signal line becomes H level, and the number m gate signal line becomes L level. Therefore the switching TFT 2501 turns off, and the refresh TFT 2551 turns on. At this point $V_1$=VSS is input to the gate electrode of the driver TFT 2502, which turns off.

A number (m−1) horizontal period is completed, and the gate signal line (G(m−1)) becomes L level. The refresh TFT 2551 accordingly turns off. A number m horizontal period begins, the gate signal line (G(m)) becomes H level, and the switching TFT 2501 thus turns on. The digital image signal output to the source signal line is written into the pixel at this point. The switching TFT turns on when the digital image signal is H level, and therefore the electric potential of the gate electrode of the driver TFT 2502 rises.

However, the gate signal line (G(m)) is H level, its electric potential is VDD, the digital image signal is H level, and its electric potential is the same, VDD. The electric potential appearing at the output electrode of the switching TFT is influenced by the threshold value. Therefore the switching TFT turns off when the electric potential becomes (VDD−VthN), and the output electrode of the switching TFT, namely the gate electrode of the driver TFT 2502, is placed in a floating state.

On the other hand, the electric potential of the output electrode of the switching TFT 2501 rises up to (VDD−VthN). Therefore the compensation TFT 2552 turns on, and the electric potential of the output electrode rises, approaching VDD. A capacitive coupling exists at this point between the output electrode and the gate electrode of the compensation TFT 2552 due to the first capacitive means 2553. The gate electrode of the compensation TFT 2552 is in a floating state with its electric potential being at (VDD−VthN), and therefore the electric potential rise of the output electrode of the compensation TFT 2552 causes a further rise. The electric potential of the gate electrode of the compensation TFT 2552 becomes higher than VDD.

As a result, the digital image signal attenuated once by VthN receives amplitude compensation by the voltage compensation circuit 2510, through the switching TFT 2501, and is input to the gate electrode of the driver TFT 2502. A normal gate-source voltage can therefore be imparted to the driver TFT 2502, and a desired drain current can flow.

The electric potential applied to the gate electrode of the driver TFT 2502 is maintained by the first and the second capacitive means 2553 and 2554 after selection of the gate signal line is complete, and additionally, after an address (writing) period is complete. The drain current thus flows, and the EL element 2504 emits light. In the next subframe period, the refresh TFT 2551 turns on when the number (m−1) row gate signal line (G(m−1)) is selected and becomes H level, and the electric potential of the gate electrode of the driver TFT 2502 becomes L level. The driver TFT 2502 turns off. Image display on a screen is performed by repeating the above operation.

A discussion of the first capacitor 2553 and the second capacitor 2554 is added here.

The first capacitive means 2553 is placed between the output electrode and the gate electrode of the compensation TFT 2552. The first capacitive means 2553 is a capacitive means for performing operations on the electric potential of the gate electrode by capacitive coupling, utilizing the electric potential rise of the output electrode. The second capacitive means 2554 is arranged in series with the first capacitive means 2553, and capacitive coupling is formed between the electric current supply line, having a fixed electric potential, and the driver TFT 2502. The second capacitive means 2554 is used for storing the electric potential of the gate electrode of the driver TFT 2502.

The second capacitive means 2554 has one further role of a load for performing bootstrap operation of the voltage compensation circuit 2510 with certainty. If this load is not present, then the electric potential of the gate electrode of the compensation TFT 2552 will begin to climb due to the input of the digital image signal from the source signal line. If the electric potential becomes greater than the threshold value, then the electric potential of the output electrode of the compensation TFT 2552 will immediately climb. The bootstrap may not work properly if the electric potential climb of the output electrode is too fast. Consequently, the electric potential climb of the output electrode of the compensation TFT 2552 is delayed by using the second capacitive means 2554 as a load, and the gate electrode is placed in a floating state before the rise in the electric potential of the output electrode stops. The bootstrap operation can thus be performed with certainty.

A gate signal line selection pulse normally requires a larger voltage amplitude than the voltage amplitude of the digital image signal input to the source signal line. In accordance with the above-stated method, it becomes possible to make the voltage amplitude of the gate signal line selection pulse equal to, or less than, that of the digital image signal. It therefore becomes possible to reduce the electric power consumption of the gate signal line driver circuit.

Figure 26A:
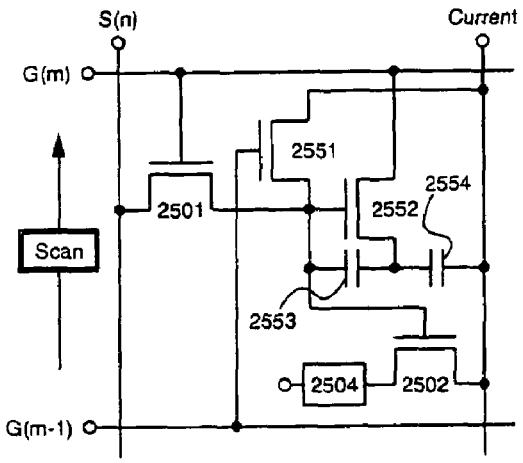
FIGS. 26A to 26C are diagrams showing an embodiment mode of the present invention.
Figure 26B:
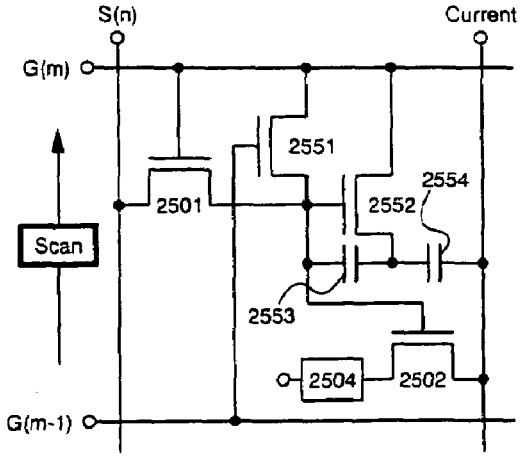
Figure 26C:
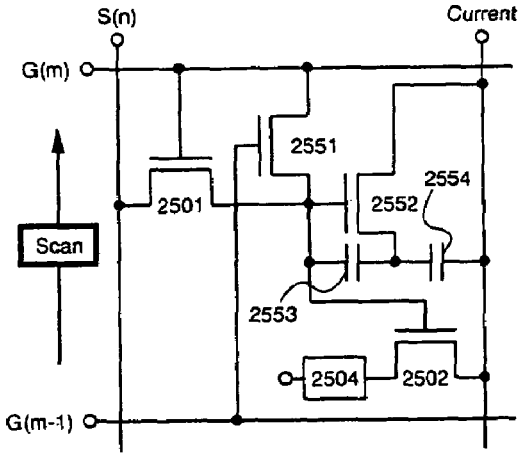

Further, for cases in which the structure shown in FIGS. 25A and 25B is used in an actual circuit, FIGS. 26A to 26C show structures for imparting desired electric potentials to each of the nodes. The connection location of the input electrodes of the refresh TFT 2551 and the compensation TFT 2552 differs among the structures, which are otherwise similar.

EMBODIMENTS

Embodiments of the present invention are discussed below.

Embodiment 1

An example of performing SES drive containing an erasure period using a pixel having an added erasure mechanism is explained in Embodiment 1.

Figure 2A:
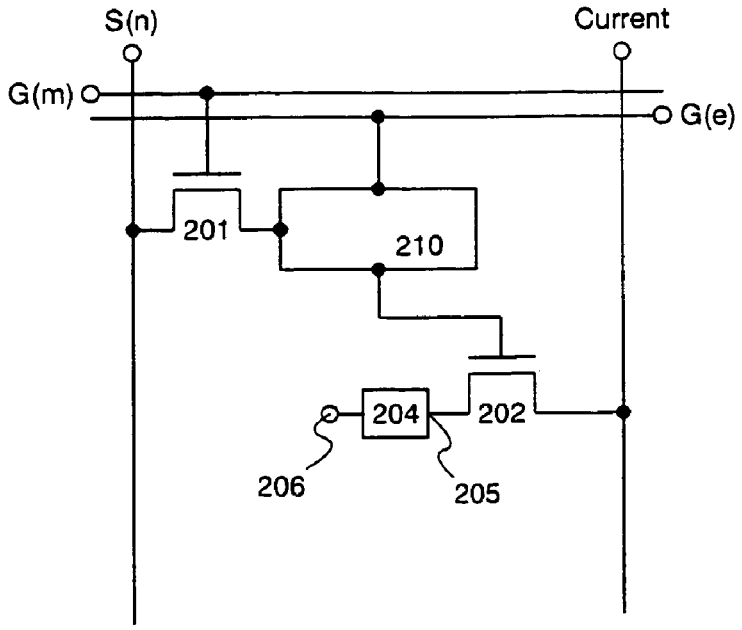
FIGS. 2A and 2B are diagrams showing an embodiment of the present invention.
Figure 2B:
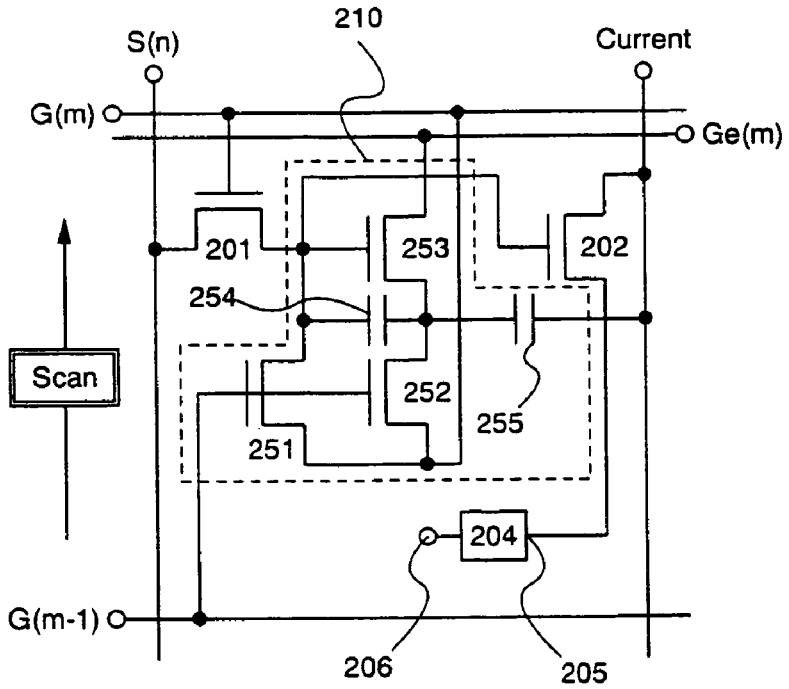
Figure 3A:
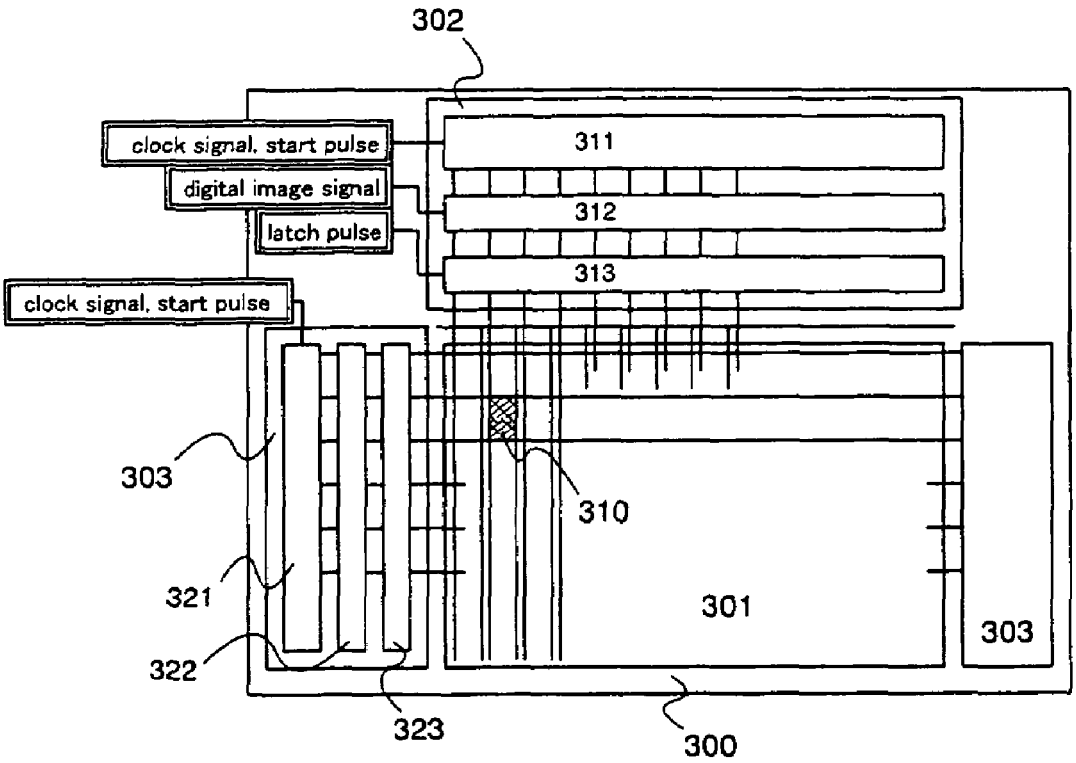
FIGS. 3A and 3B are diagrams showing a structure of a conventional light emitting device.
Figure 3B:
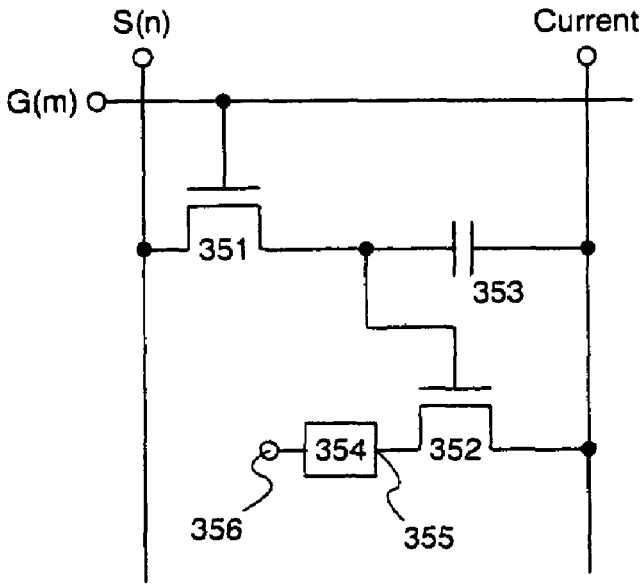
Figure 4A:
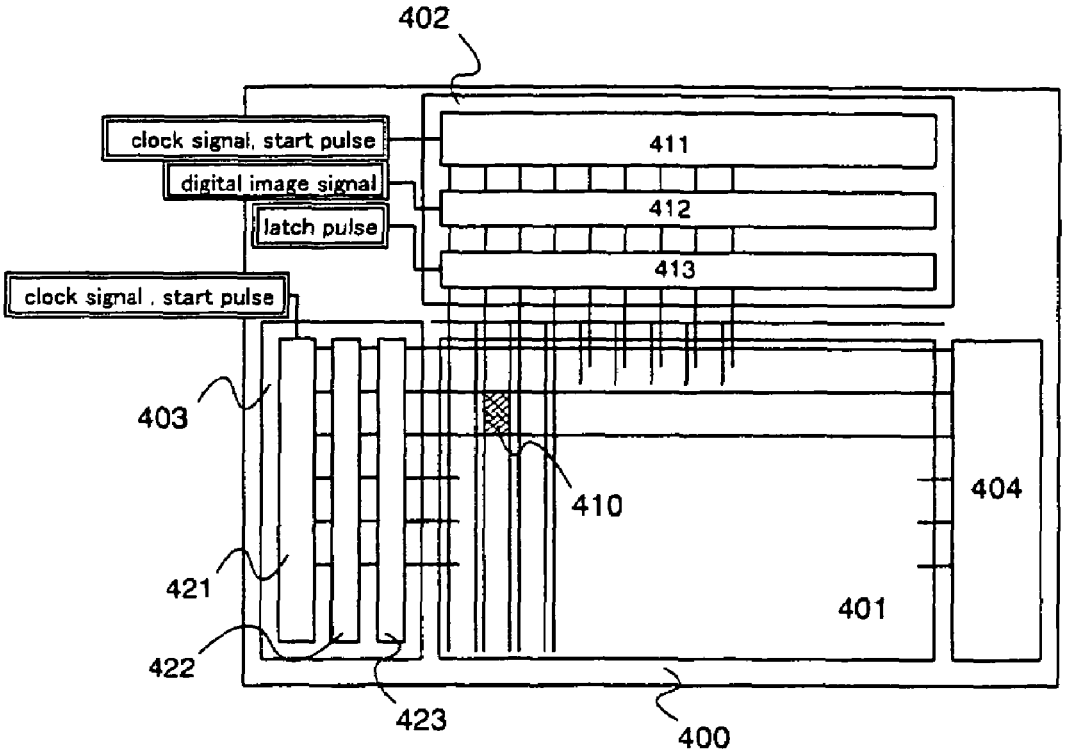
FIGS. 4A and 4B are diagrams showing a structure of a conventional light emitting device.
Figure 4B:
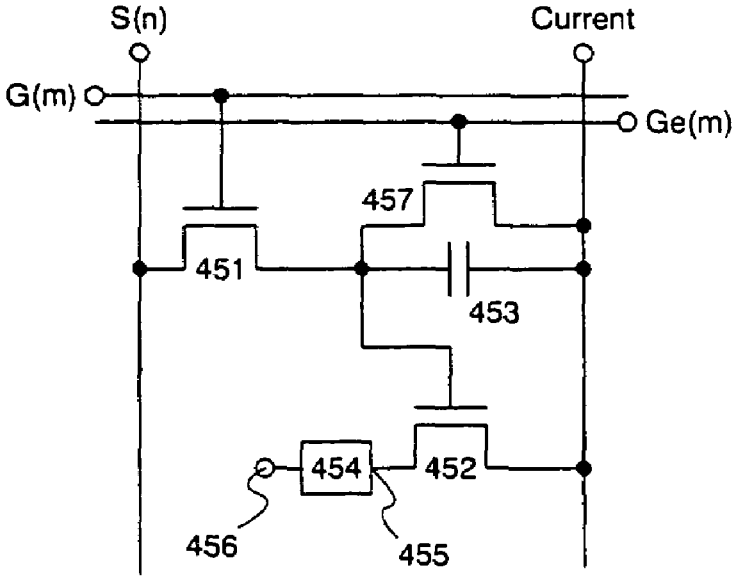
Figure 5A:
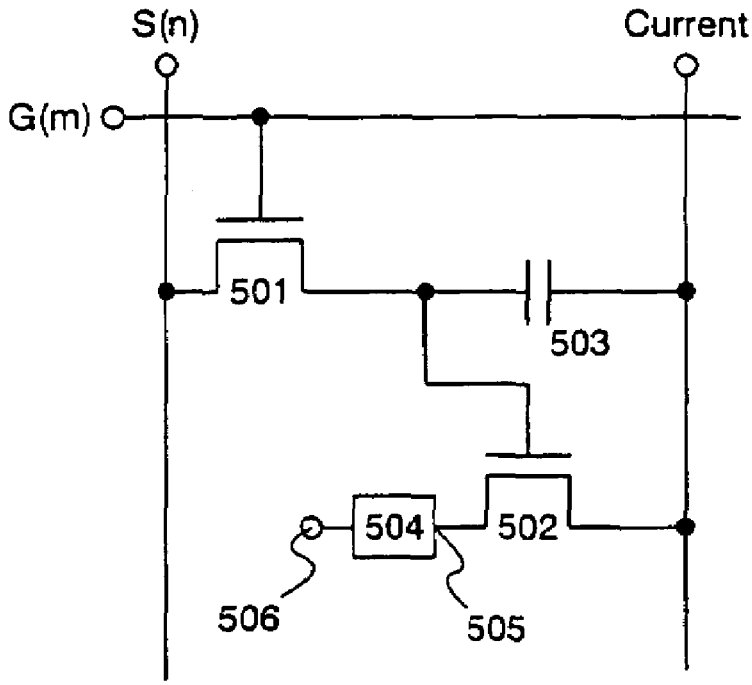
FIGS. 5A and 5B are diagrams for explaining pixel portion TFTs and the operation of a light emitting element, respectively.
Figure 5B:
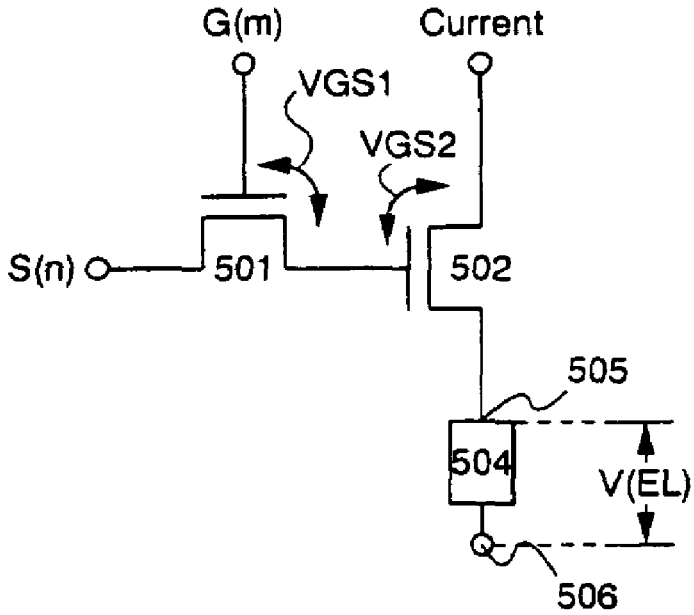

FIGS. 2A and 2B show structures of a pixel having an erasure mechanism of Embodiment 1. As shown in FIG. 2A, the pixel has a switching TFT 201, a driver TFT 202, an EL element 204, a source signal line (S), a gate signal line (G), and a current supply line (current), which are similar to conventional components, and has a voltage compensation circuit 210 that is similar to the voltage compensation circuit of Embodiment Mode 1. In addition to the gate signal line (G), the pixel also has an erasure gate signal line (Ge) in Embodiment 1. Note that, with respect to the erasure gate signal line (Ge), the normal gate signal line is referred to as a writing gate signal line in Embodiment 1.

FIG. 2B is a circuit diagram containing the structure of the voltage compensation circuit 210. The voltage compensation circuit 210 has a first TFT 251, a second TFT 252, a third TFT 253, a first capacitor 254, and a second capacitor 255. Further, reference symbol G(m) denotes a writing gate signal line scanned in a number m row, and reference symbol G(m−1) denotes a gate signal line scanned in a number (m−1) row. Reference symbol Ge(m) denotes an erasure gate signal line scanned in the number m row.

The first capacitor 254 and the second capacitor 255 are arranged in series. A first electrode of the first capacitor 254 is connected to the output electrode of the switching TFT 201, and a second electrode of the first capacitor 254 is connected to a first electrode of the second capacitor 255. A second electrode of the second capacitor 255 is connected to the current supply line.

A gate electrode of the first TFT 251 is connected to the writing gate signal line G(m−1), an input electrode of the first TFT 251 is connected to the writing gate signal line G(m), and an output electrode of the first TFT 251 is connected to the output electrode of the switching TFT 201.

A gate electrode of the second TFT 252 is connected to the writing gate signal line G(m−1), and an input electrode of the second TFT 252 is connected to the writing gate signal line G(m). An output electrode of the second TFT 252 is connected to the second electrode of the first capacitor 254, and to the first electrode of the second capacitor 255.

A gate electrode of the third TFT 253 is connected to the output electrode of the switching TFT 201, and an input electrode of the third TFT 253 is connected to the erasure gate signal line Ge(m). An output electrode of the third TFT 253 is connected to the second electrode of the first capacitor 254, and to the first electrode of the second capacitor 255.

Note that TFTs all having the same polarity are used here for the TFTs 201, 202, and 251 to 253 structuring the pixel. The polarity may be n-channel or p-channel type.

Circuit operation is explained next. An example in which the TFTs structuring the pixel are all n-channel TFTs is used here. The amplitude of input signals is set to VDD (H level)−VSS (L level) for signals input from the source signal line, for signals that select the writing gate signal line, and for signals that select the erasure gate signal line. In addition, as an initial state, the electric potential of the source signal line (S) and the electric potential of the gate signal line (G) are both set to VSS, and the electric potential of the current supply line (current) and the electric potential of the erasure gate signal line are both set to VDD.

Figure 12A:
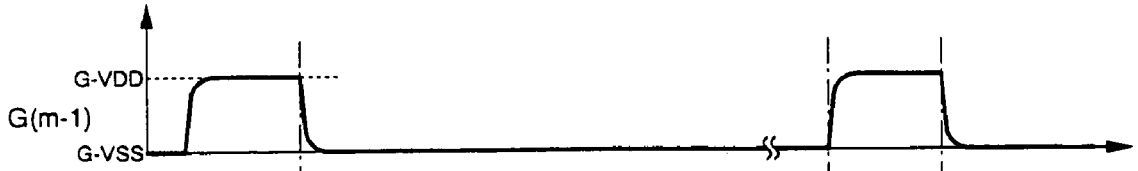
FIGS. 12A to 12E are diagrams showing the electric potential of each node at the time of driving a pixel of a light emitting device of the present invention.
Figure 12B:
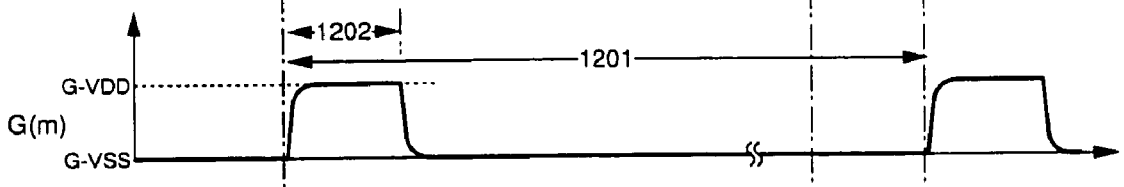
Figure 12C:
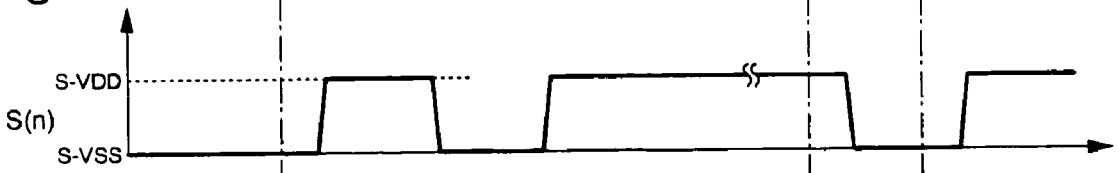
Figure 12D:
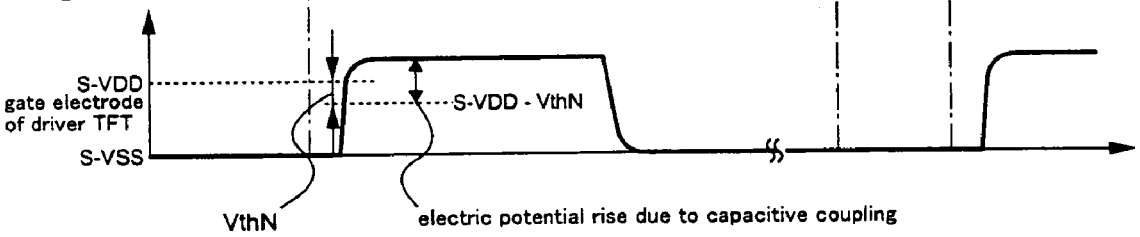
Figure 12E:
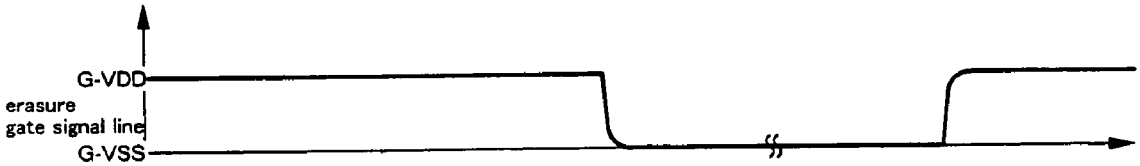

Further, the threshold voltages of the TFTs are all taken as VthN. FIGS. 12A to 12E are timing charts for explaining the operation of the circuits of the present invention shown in FIGS. 2A and 2B. FIG. 12A shows the electric potential of the number (m−1) row gate signal line (G(m−1)), FIG. 12B shows the electric potential of the number m row writing gate signal line (G(m)), FIG. 12C shows the electric potential of a source signal line (S(n)), FIG. 12D shows the electric potential of the gate electrode of the driver TFT 102, and FIG. 12E shows the electric potential of the erasure gate signal line. Further, a period 1201 from after the number m row writing gate signal line (G(m)) is selected, until the number m row writing gate signal line (G(m)) is selected again corresponds to a subframe period shown in FIG. 9F. A period denoted by reference numeral 1202 is one horizontal period. FIGS. 2A and 2B, and FIGS. 12A to 12E are used in the explanation of the operation.

The number (m−1) row gate signal line (G(m−1)) is selected and becomes H level, and writing of a digital image signal to the number (m−1) row pixel is performed. At this point in the number m row of pixels, H level is input to the gate electrodes of the first TFT 251 and the second TFT 252, which turn on. Both electrodes of the first capacitor 254 become equal to the electric potential of the number m row gate signal line, namely VSS. At the same time, the electric potential of the gate electrode of the driver TFT 202 also becomes VSS.

The number (m−1) row gate signal line (G(m−1)) selection period then is complete, its electric potential becomes L level, and the first TFT 251 and the second TFT 252 are placed in an off state. The number m row gate signal line (G(m)) is selected and becomes H level, and the switching TFT 201 turns on. The electric potential of the source signal line (S(n)) at this point, namely the digital image signal, is input to the gate electrode of the driver TFT 202, which is turned on. The digital image signal is simultaneously input to the gate electrode of the third TFT 253, which turns on.

At the point where the electric potentials of the gate electrodes of the driver TFT 202 and the third TFT 253 become (VDD−VthN), the voltage between the gate and the source of the switching TFT 201 becomes equal to the threshold voltage VthN, and the switching TFT 201 is placed in an off state as a result. The gate electrode of the driver TFT 202 and the gate electrode of the third TFT 253 are therefore temporarily placed in a floating state.

On the other hand, the electric potential of the output electrode side of the third TFT 253 rises when the third TFT 253 turns on. A capacitive coupling exists at this point between the output electrode of the third TFT 253 and the gate electrode of the driver TFT 202 due to the first capacitor 254. The gate electrode of the driver TFT 202 is in a floating state, and therefore the electric potential of the gate electrode of the driver TFT 202 once again rises from (VDD—VthN), along with the rising electric potential of the output electrode of the third TFT 253, and becomes an electric potential higher than VDD. Strictly speaking, it becomes an electric potential higher than (VDD+VthN).

As a result, the digital image signal attenuated once by VthN receives amplitude compensation by the voltage compensation circuit, through the switching TFT 201, and is applied to the gate electrode of the driver TFT 202. The driver TFT 202 is therefore normally turned on, and a desired drain current can be obtained.

The electric potential applied to the gate electrode of the driver TFT 202 is thereafter maintained by the capacitors 254 and 255, an electric current flows, and the EL element 204 emits light.

In a subframe period having an erasure period, the electric potential of the number m row erasure gate signal line (Ge(m)) becomes L level, and the electric potential on the input electrode side of the third TFT 253 drops. The electric potential of the gate electrode of the driver TFT 202 also drops at the same time due to capacitive coupling by the first capacitor 254. As a result, the electric potential of the gate electrode of the driver TFT 202 falls below the threshold voltage, the driver TFT 202 turns off, and electric current to the EL element 204 is cutoff. The EL element thereafter does not emit light.

In the next subframe period, the first TFT 251 and the second TFT 252 turn on when the number (m−1) row gate signal line (G(m−1)) is selected, and the electric potential of the gate electrode of the driver TFT 202 becomes equal to the electric potential of the number m row gate signal line (G(m)), namely L level. The electric potential of the number m row erasure gate signal line (Ge(m)) once again becomes H level, the number m row gate signal line is selected, and writing of the digital image signal is performed. Image display is performed by subsequently repeating these procedures.

Embodiment 2

An example of manufacturing a light emitting device having the pixel shown in Embodiment Modes 1 and 2 is discussed in Embodiment 2.

Figure 20A:
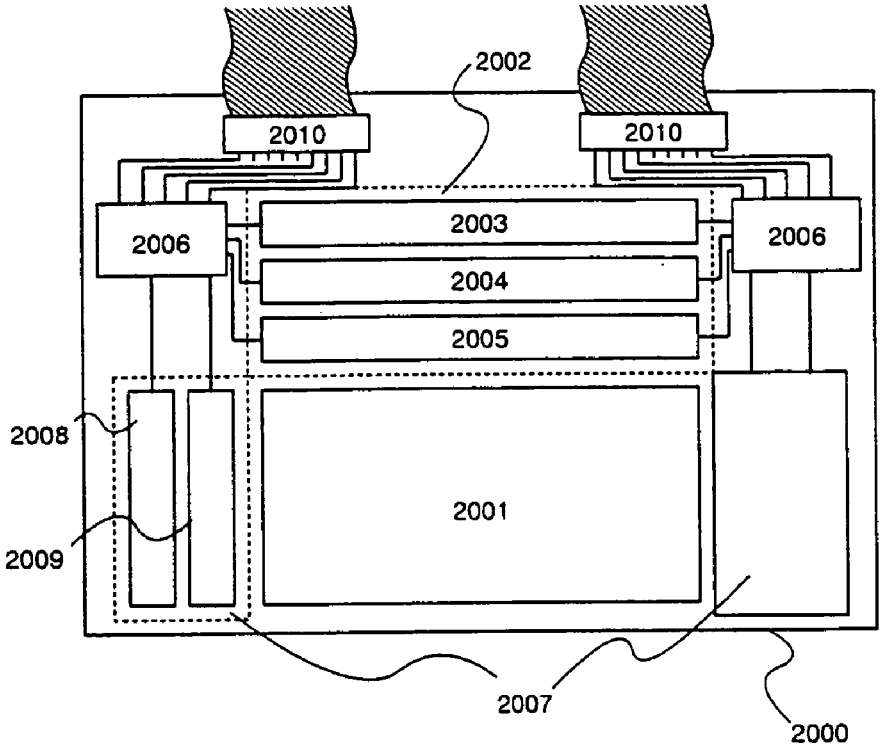
FIGS. 20A and 20B are schematic diagrams of an entire light emitting device of the present invention.

A schematic diagram of a light emitting device is shown in FIG. 20A. A pixel portion 2001 is placed in a center portion of a substrate 2000. Although not shown in particular in FIG. 20A, the structure of one pixel is the same as that shown in FIGS. 1A and 1B. A source signal line driver circuit 2002 for controlling source signal lines, and gate signal line driver circuits 2007 for controlling gate signal lines are formed in the periphery of the pixel portion 2001. One of the gate signal line driver circuits 2007 may also be formed on only one side of the pixel portion 2001 as described above.

Signals input from the outside for driving the source signal line driver circuit 2002 and the gate signal line driver circuits 2007 are input through an FPC 2010. Signals input from the FPC 2010 have small voltage amplitudes, and therefore undergo the transformation of the voltage amplitudes by level shifters 2006, and then, they are input to the source signal line driver circuit 2002 and the gate signal line driver circuits 2007 in Embodiment 2.

Figure 13:
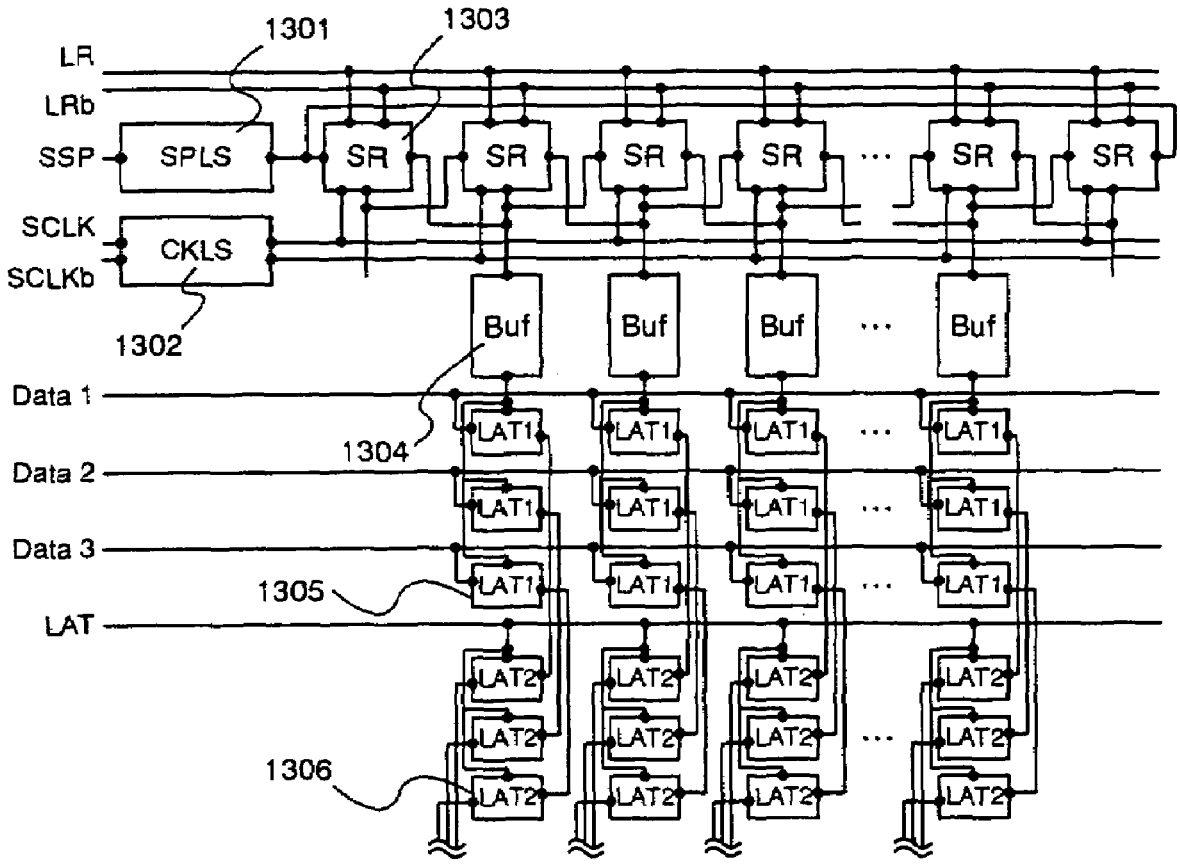
FIG. 13 is a structural diagram of a source signal line driver circuit structuring a light emitting device of the present invention.
Figure 20B:
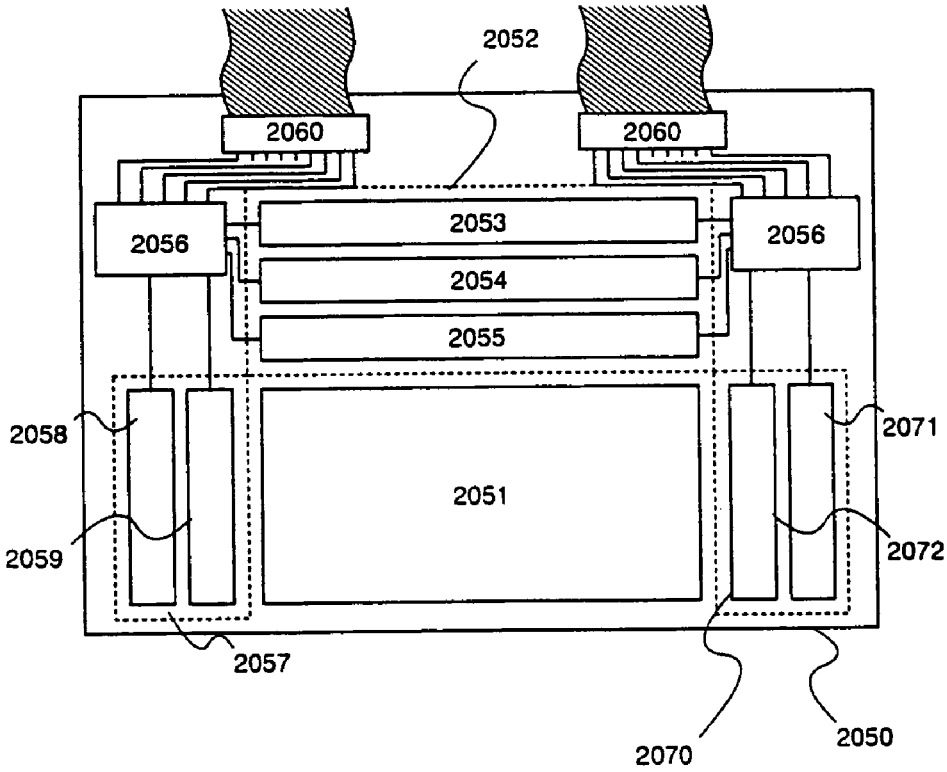

FIG. 13 is a diagram showing the structure of the source signal line driver circuit. The source signal line driver circuit has shift registers 1303, buffers 1304, first latch circuits 1305, and second latch circuits 1306. Buffers are not shown in FIGS. 20A and 20B, but buffers may be formed, as shown in FIG. 13, for cases in which the load downstream of the shift registers is large, for example.

A source side clock signal (SCLK), a source side clock inverted signal (SCLKb), a source side start pulse (SSP), a scanning direction switching signal (LR), a scanning direction switching inverted signal (LRb), and digital image signals (data 1 to 3) are input to the source signal line driver circuit. Among these signals, the clock signal and the start pulse are input after undergoing amplitude transformation by the level shifters 1301 and 1302.

Figure 14A:
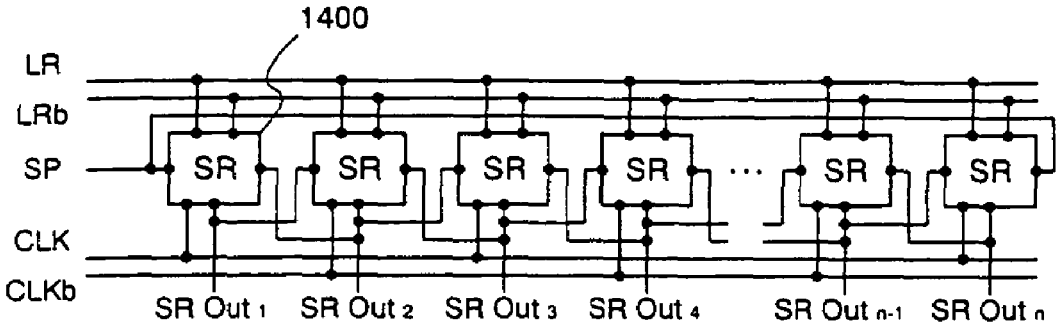
FIGS. 14A and 14B are circuit structure diagrams of a shift register.
Figure 14B:
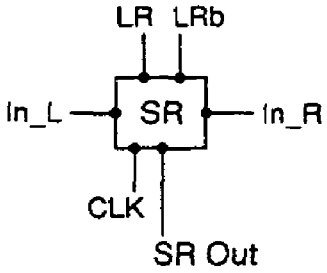
Figure 14B:
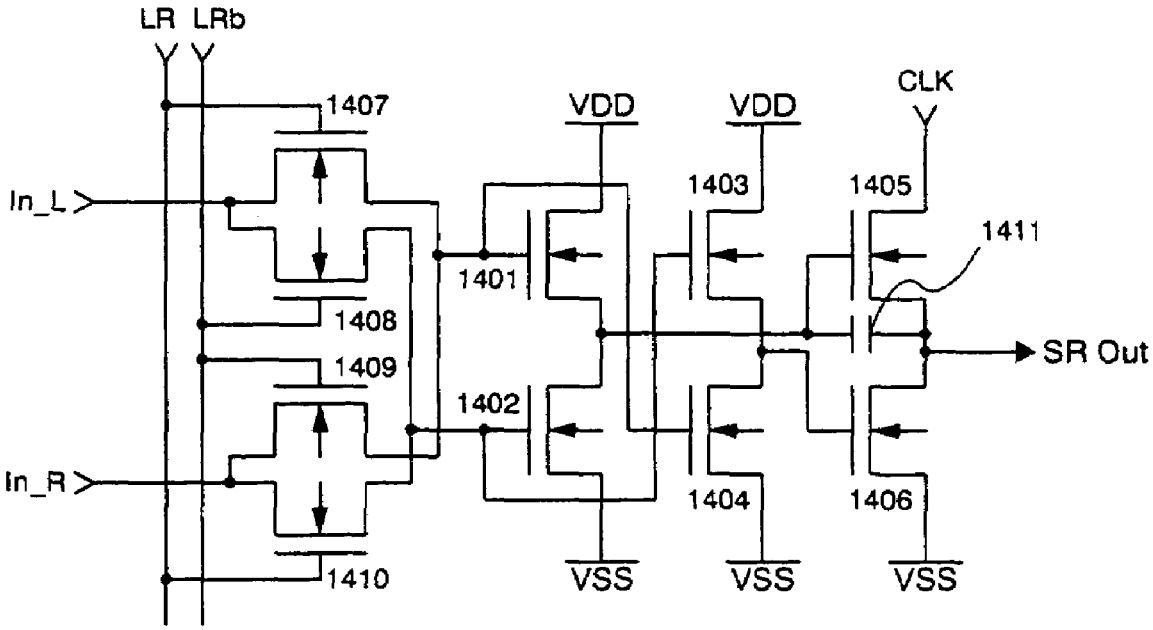

The structure of the shift registers is shown in FIGS. 14A and 14B. A block denoted by reference numeral 1400 in a block diagram of FIG. 14A is a pulse output circuit for outputting one stage portion of sampling pulses. Shift registers of FIG. 14A are structured by n stages (where n is a natural number, 1<n) of pulse output circuits.

FIG. 14B is a diagram showing the structure of the pulse output circuit in detail. TFTs 1407, 1408, 1409, and 1410 are switching TFTs formed for switch over of the scanning direction. Switch over of left and right scanning directions is performed by the scanning direction switching signal (LR) and the scanning direction switching inverted signal (LRb).

For forward direction scanning, the sampling pulse output is a first stage, a second stage, . . . , a number (n−1) stage, and a number n stage in order. For reverse direction scanning, the sampling pulse output is the number n stage, the number (n−1) stage, . . . , the second stage, and the first stage, in order.

The pulse output circuit body is composed of TFTs 1401 to 1406, and a capacitor 1411. In the pulse output circuit for a certain number k stage (where k is a natural number, 1<k<n), output pulses from the number (k−1) stage pulse output circuit or output pulses from the number (k+1) stage pulse output circuit are input to gate electrodes of the TFTs 1401 and 1404, and gate electrodes of the TFTs 1402 and 1403, respectively. Note that start pulses (SP) are input to the gate electrodes of the TFTs 1401 and 1404 when k=1, namely in the initial stage pulse output circuit, and that start pulses (SP) are input to the gate electrodes of the TFTs 1402 and 1403 when k=n, namely in the final stage pulse output circuit.

H level is input to the scanning direction switching signal (LR), and L level is input to the scanning direction switch over inverted signal (LRb), in scanning in the forward direction. The TFTs 1407 and 1410 therefore turn on, and output pulses from the number (k−1) stage pulse output circuit are input to the gate electrodes of the TFTs 1401 and 1404. On the other hand, output pulses from the number (k+1) stage pulse output circuit are input to the gate electrodes of the TFTs 1402 and 1403.

A case of forward scanning is used as an example here for explaining detailed circuit operation. Please refer to the timing chart shown in FIG. 15.

In a certain number k stage pulse output circuit, output pulses from the number (k−1) stage pulse output circuit are input to the gate electrodes of the TFTs 1401 and 1404, which become H level (start pulses are input if k=1, namely for the initial stage). The TFTs 1401 and 1404 turn on (refer to FIG. 15, reference numeral 1501). The electric potential of a gate electrode of the TFT 1405 is pulled up to the VDD side (refer to FIG. 15, reference numeral 1502), and the TFT 1401 turns off and is placed in a floating state at the point where the electric potential becomes VDD−VthN. The voltage between a gate and a source of the TFT 1405 is greater than the threshold value at this point, and the TFT 1405 turns on. On the other hand, pulses are not yet input to the gate electrodes of the TFTs 1402 and 1403, which remain at L level and are therefore in an off state. The electric potential of a gate electrode of the TFT 1406 is therefore L level, and it is turned off. The electric potential of an output terminal (SR out) of the pulse output circuit is thus pulled up to the VDD side in accordance with the clock signal (SCLK or SCLKb) input to an input electrode of the TFT 1405, becoming H level (refer to FIG. 15, reference numeral 1503). In this state, however, the electric potential of the output terminal (SR out) of the pulse output circuit drops further by the threshold value with respect to the electric potential VDD−VthN of the gate electrode of the TFT 1405, and only an increase to VDD−2(VthN) is obtained.

The capacitor 1411 is formed between the gate electrode and the output electrode of the TFT 1405 here, and in addition, the gate electrode of the TFT 1405 is in a floating state. The electric potential of the gate electrode of the TFT 1405 is therefore further pulled up from VDD−VthN by the capacitor 1411 along with the rise in the electric potential of the output terminal (SR out) of the pulse output circuit, namely the rise in the electric potential of the output electrode of the TFT 1405. In accordance with this operation, the final electric potential of the gate electrode of the TFT 1405 becomes higher than VDD+VthN (refer to FIG. 15, reference numeral 1502). The electric potential of the output terminal (SR out) of the pulse output circuit is not influenced by the threshold value of the TFT 1405, and increases normally to VDD (refer to FIG. 15, reference numeral 1503).

Figure 15:
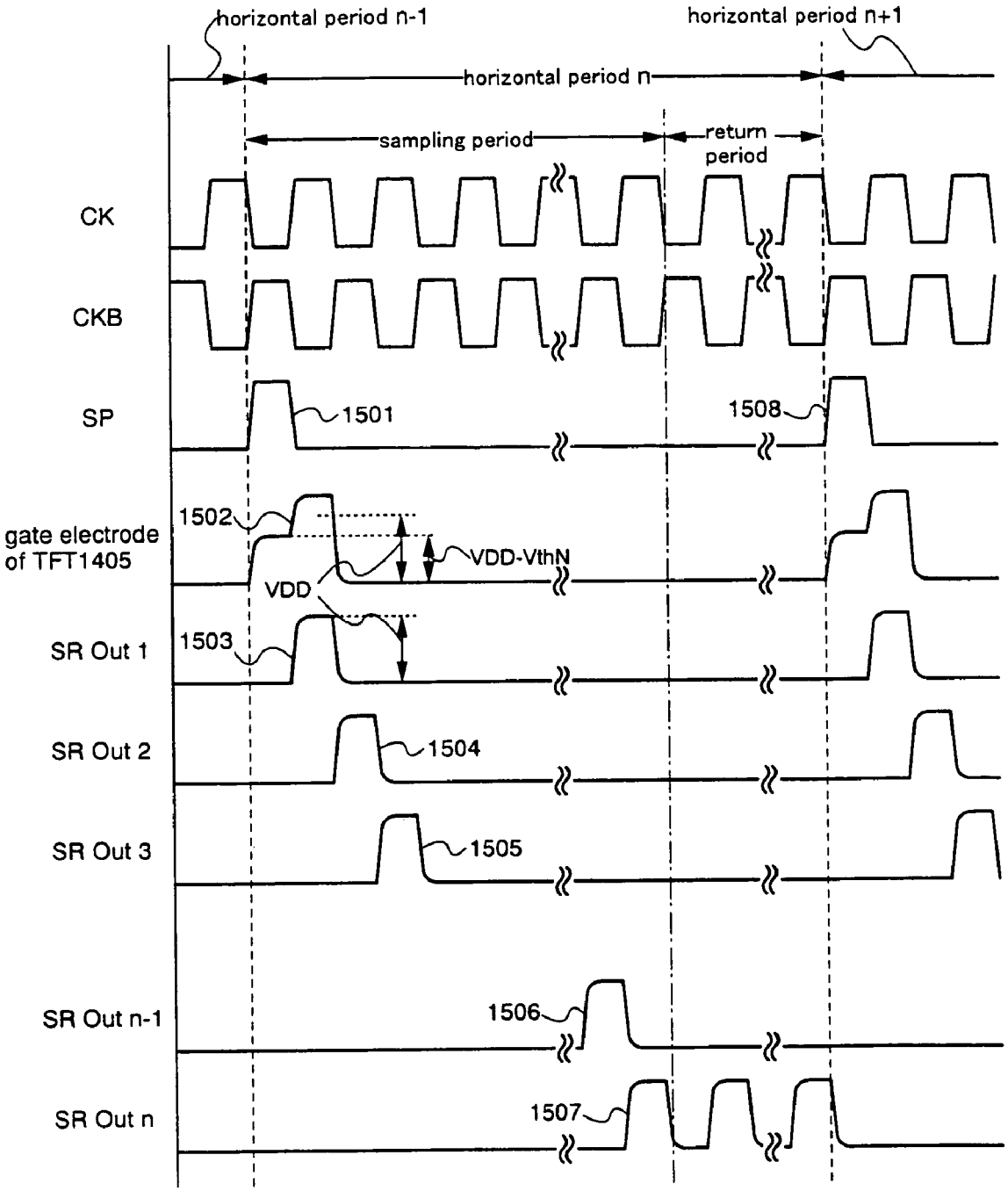
FIG. 15 is a diagram showing a timing chart relating to shift register driving.

Pulses are similarly output from the number (k+1) stage pulse output circuit (refer to FIG. 15, reference numeral 1504). The number (k+1) stage output pulses return to the number k stage and are input to the gate electrodes of the TFTs 1402 and 1403. The electric potentials of the gate electrodes of the TFTs 1402 and 1403 become H level, and the TFTs 1402 and 1403 turn on. The electric potential of the gate electrode of the TFT 1405 is pulled down to the VSS side, and the TFT 1405 turns off. Simultaneously, the electric potential of the gate electrode of the TFT 1406 becomes H level, and the TFT 1406 turns on. The electric potential of the output terminal (SR out) of the number k stage pulse output circuit becomes L level.

Pulses having amplitudes between VDD−VSS are then output one after another by similar operations up through the final stage. Circuit operation is also similar for reverse direction scanning.

In the final stage, a return pulse is not input from the next stage, and therefore the clock signal continues to be output through the TFT 1405 (refer to FIG. 15, reference numeral 1507). The output pulses of the final stage pulse output circuit therefore cannot be used as sampling pulses. Similarly, the initial stage output pulses are final output pulses for cases of reverse direction scanning, and therefore cannot be used as sampling pulses. In the circuit shown in Embodiment 2, the shift register is therefore structured using a number of pulse output circuits equal to the necessary number of stages, plus two. The pulse output circuits at both ends are handled as dummy stages (pulse output circuits to which the buffers 1304 are not connected in FIG. 13 correspond to the dummy stages). Even so, it is necessary to stop the final output by some method before the next horizontal period begins, and therefore the final output is stopped at the point where the start pulse for the next horizontal period is input by using the start pulses as initial stage inputs and final stage period inputs.

Figure 16A:
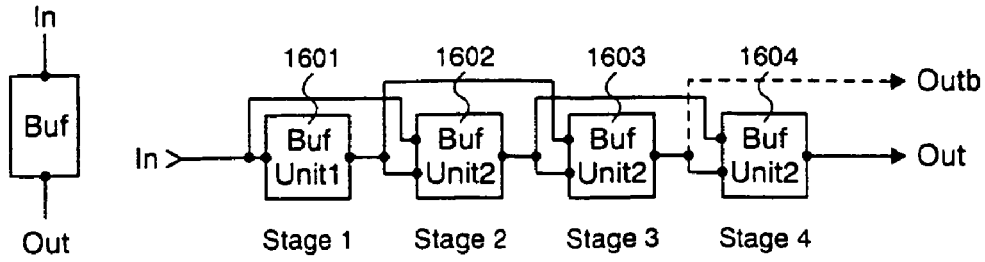
FIGS. 16A to 16C are circuit structure diagrams of a buffer.
Figure 16B:
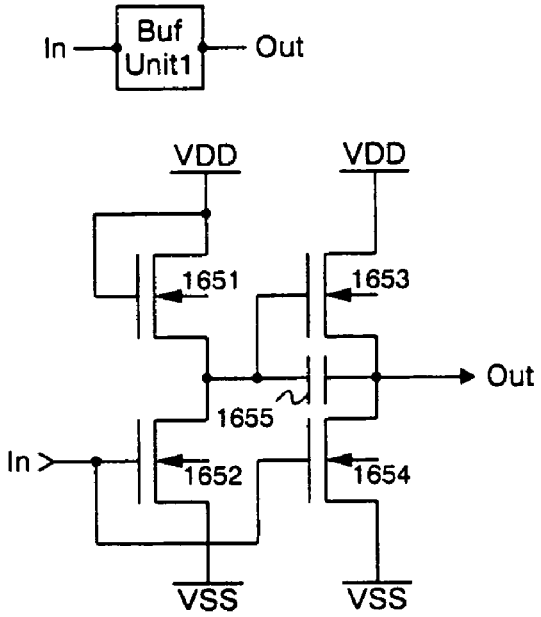

FIGS. 16A and 16B show the structure of the buffers 1304 used in the light emitting device of Embodiment 2. As shown in FIG. 16A, this is a structure having four stages 1601 to 1604. Only the first stage is a single input, single output type. The second and subsequent stages are two input, two output types.

The circuit structure of the initial stage unit 1601 is shown in FIG. 16B. Signals are input to gate electrodes of TFTs 1652 and 1654. A gate electrode of a TFT 1651 is connected to an input electrode. If H level is input to the gate electrodes of the TFTs 1652 and 1654, placing the TFTs in an on state, then the electric potential of a gate electrode of a TFT 1653 becomes L level, and as a result, an output terminal (out) becomes L level. If L level is input to the gate electrodes of the TFTs 1652 and 1654, the TFTs turn off. The gate electrode and an input electrode of the TFT 1651 are connected, the TFT 1651 is normally on, and therefore the electric potential of the gate electrode of the TFT 1653 rises. Similar to the above-stated case of the shift register, there is capacitive coupling due to a capacitor 1655, and the output therefore becomes H level.

Note that the relationship between the TFT 1651 and the TFT 1652 is as follows: the gate electrode and the input electrode of the TFT 1651 are connected, and therefore both the TFT 1651 and the TFT 1652 are in an on state when the TFT 1652 turns on. It is necessary for the electric potential of the gate electrode of the TFT 1653 to become L level in this state, and therefore it is necessary to design the channel width of the TFT 1651 to be smaller than that of the TFT 1652. It is sufficient if only one gate electrode of the TFT 1653 has the capability of being charged, and therefore the channel width of the TFT 1651 may be set to a minimum value. Furthermore, increases in electric current consumption due to the penetration path among VDD, the TFT 1651, the TFT 1652, and VSS in a period during which the TFT 1652 is on can be reduced to a minimum by making the TFT 1651 smaller.

Figure 16C:
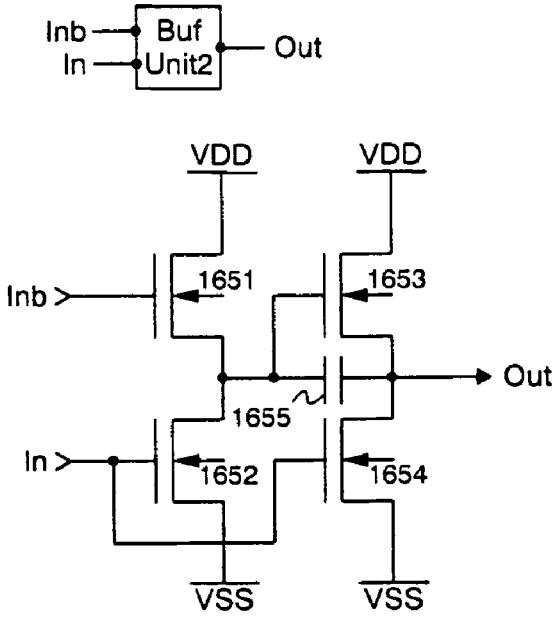

FIG. 16C shows the structure of the unit circuit used in the second and later stages. Input to the gate electrode of the TFT 1652 is similar to that of the initial stage, and in addition, the previous stage input is used as an inverted input to the gate electrode of the TFT 1651. The TFTs 1651 and 1652 are thus exclusively on and off, respectively, and the penetration path between VDD, the TFT 1651, the TFT 1652, and VSS can be eliminated in the structure of FIG. 16B.

FIGS. 17A to 17D show structures of a clock signal level shifter (A) and a start pulse level shifter (B) used in the light emitting device of Embodiment 2. The basic structure has four stages, a level shifter for an initial stage, and buffers for the second and following stages, similar to the aforementioned buffer circuits. A signal having an amplitude of $VDD_{LO}$−VSS is input, and an output signal having an amplitude of VDD−VSS is obtained (where $|VDD_{LO}|<|VDD|$ here).

Regarding the clock signal level shifter, the initial stage is a one input, one output type, while the second and subsequent stages are two input, one output types. The clock signal level shifters are used for making the mutual inputs into inverted inputs.

The start pulse level shifter has a structure similar to that of the aforementioned buffers.

Figure 17A:
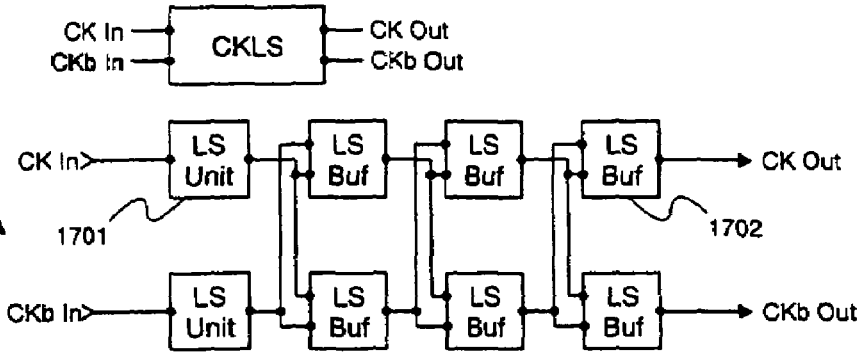
FIGS. 17A to 17D are circuit structure diagrams of a level shifter.
Figure 17B:
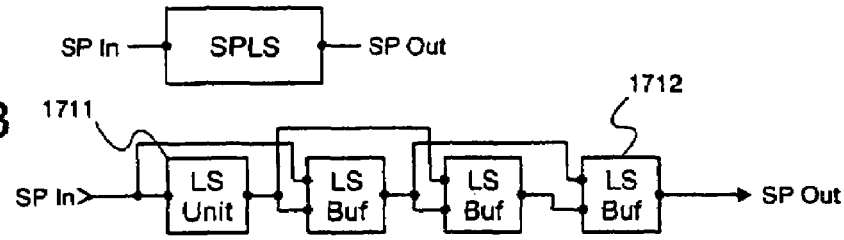
Figure 17C:
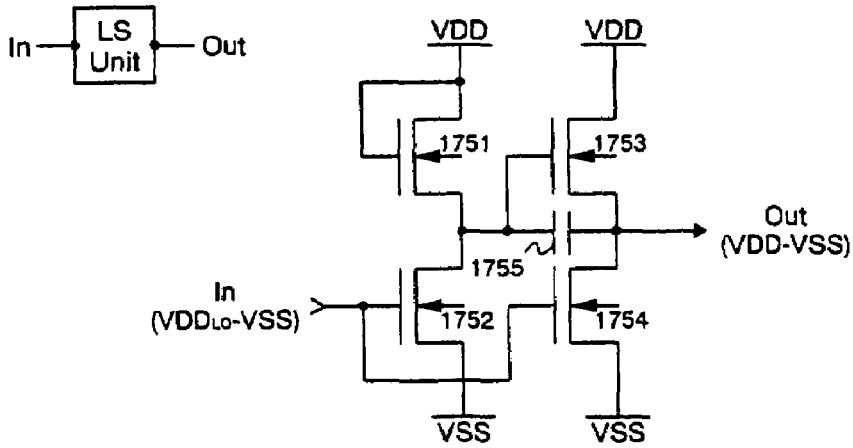
Figure 17D:
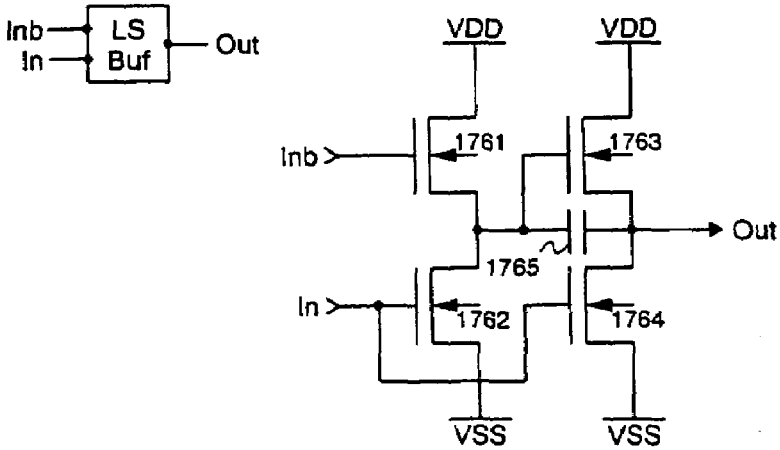

The unit circuit structure used in the initial stage of the level shifter is shown in FIG. 17C, while the unit circuit structure for the second and subsequent stages is shown in FIG. 17D. The circuit structure and operation are similar to those shown in FIGS. 16B and 16C, respectively. The only point of difference is that the amplitude of the signal input in the initial stage is $VDD_{LO}$−VSS.

A TFT 1752 turns on when the signal input to a gate electrode of the TFT 1752 is H level (for cases in which the absolute value $|VDD_{LO}-VSS|$ of the amplitude of the input signal is certainly greater than the absolute value |VthN| of the threshold value of the TFT 1752). The electric potential of a gate electrode of a TFT 1753 is pulled down to the VSS side, and therefore L level appears at an output terminal (out). On the other hand, if the signal input to the gate electrode of the TFT 1752 is L level, then the TFT 1752 turns off, and the electric potential of the gate electrode of the TFT 1753 is pulled up to the VDD side, through the TFT 1751. Subsequent operations are similar to those of the aforementioned buffer.

This level shifter structure has a characteristic that the input signal is not directly input to the gate electrode in controlling the TFT 1751 connected to the high electric potential side (VDD side). Consequently, the electric potential of the gate electrode of the TFT 1753 can be pulled up, no matter what the threshold value of the TFT 1751 is, even if the amplitude of the input signal is small. A high amplitude transformation gain is therefore obtained.

Figure 18:
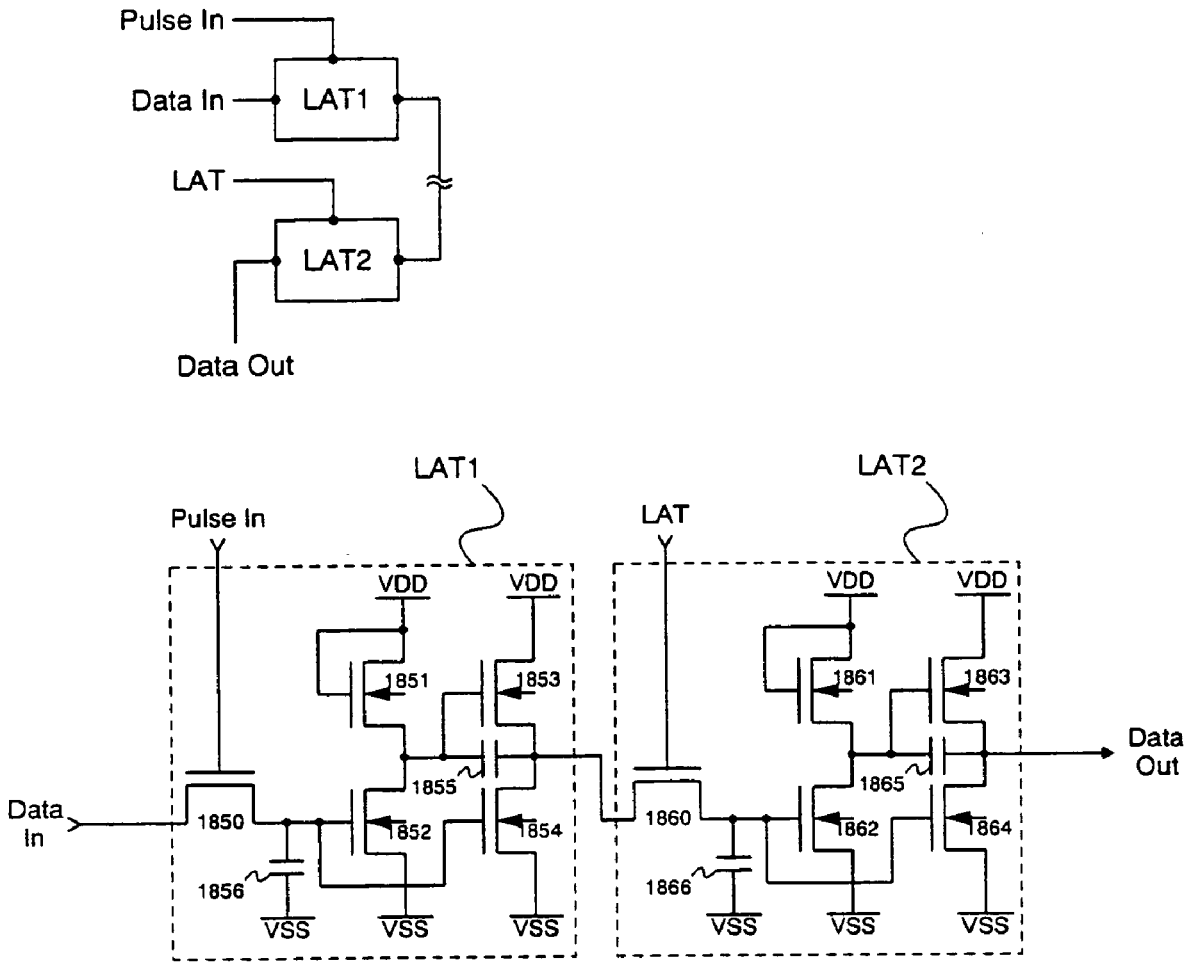
FIG. 18 is a circuit structure diagram of a latch circuit.
Figure 21A:
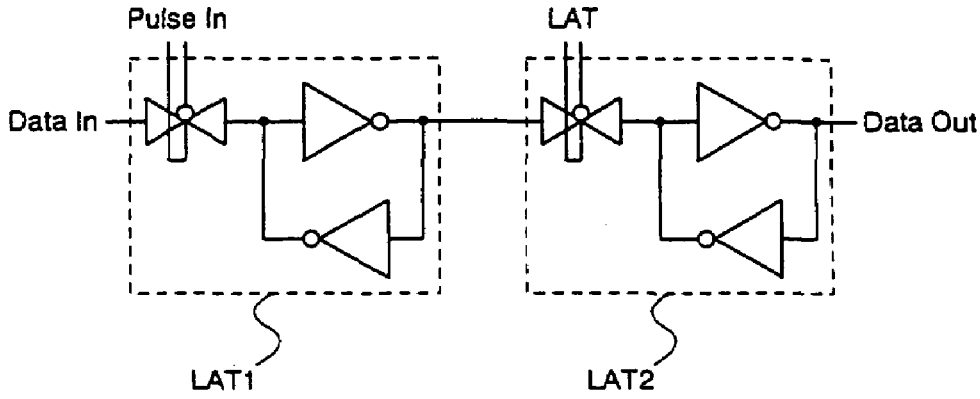
FIGS. 21A to 21C are diagrams showing examples of general latch circuit structures.
Figure 21B:
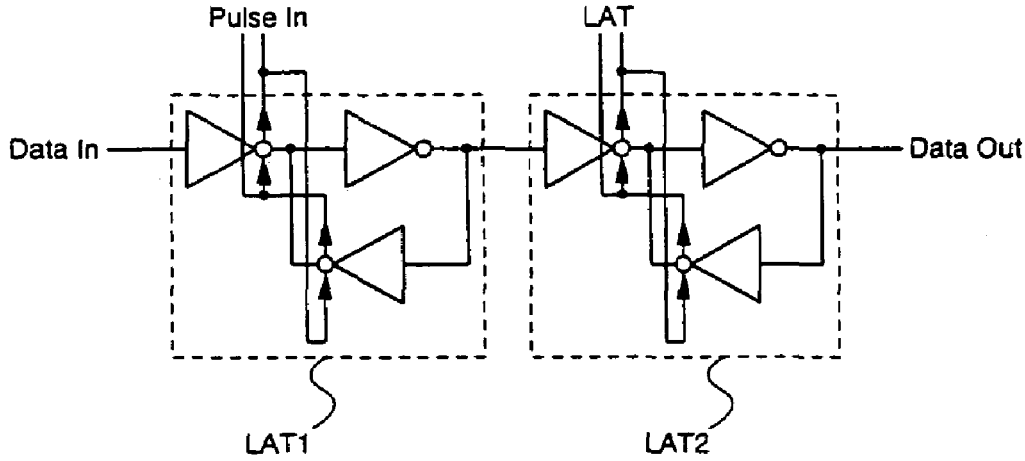
Figure 21C:
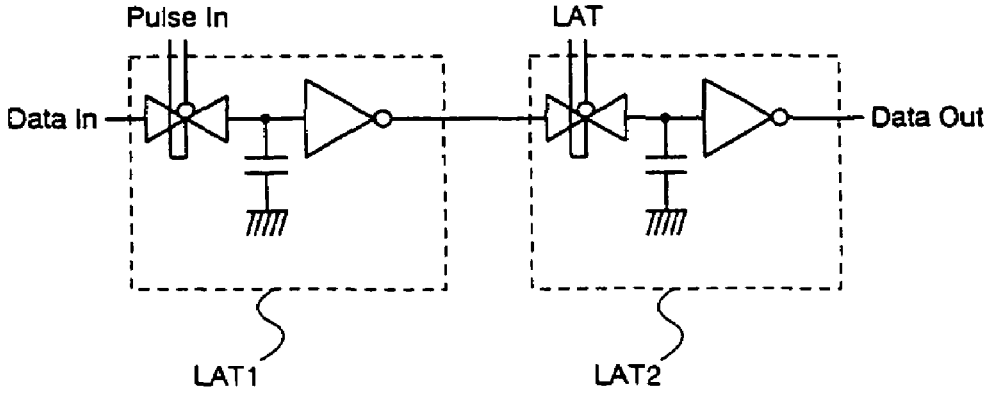

FIG. 18 shows the structure of the first latch circuit and the second latch circuit used in the light emitting device of Embodiment 2. As shown in FIG. 21A, a structure composed of a storage portion in which two inverters are connected in a loop shape, and a switch for controlling storage timing, is a general structure as an example of a conventional CMOS latch circuit. In addition, the structure of FIG. 21B using a D-FF (flip-flop) circuit can also be given as an example. FIG. 21C is the simplest DRAM structure, and storage portions are structured by an inverter and a capacitor. The electric potential of a signal input to the inverters of a first latch circuit (LAT1) and a second latch circuit (LAT2) is stored by the capacitors. The simplest structure in FIG. 21C is used in Embodiment 2.

The latch circuits shown in FIG. 18 are structured such that one n-channel TFT replaces an analog switch of FIG. 21C, and an NMOS inverter composed of four n-channel TFTs and a capacitor replaces a CMOS inverter.

If a digital image signal is input (data in) from an input electrode of a TFT 1850, and a sampling pulse is input (pulse in) to a gate electrode, turning the TFT 1850 on, then the digital image signal is input to an inverter composed of TFTs 1851 to 1854 and a capacitor 1855, the polarity is inverted, and the signal is output. Further, the digital image signal is stored using a capacitor 1856.

The digital image signal is also written into, and stored in, the second latch circuit by similar operations in accordance with a latch pulse (LAT) input timing.

Figure 19:
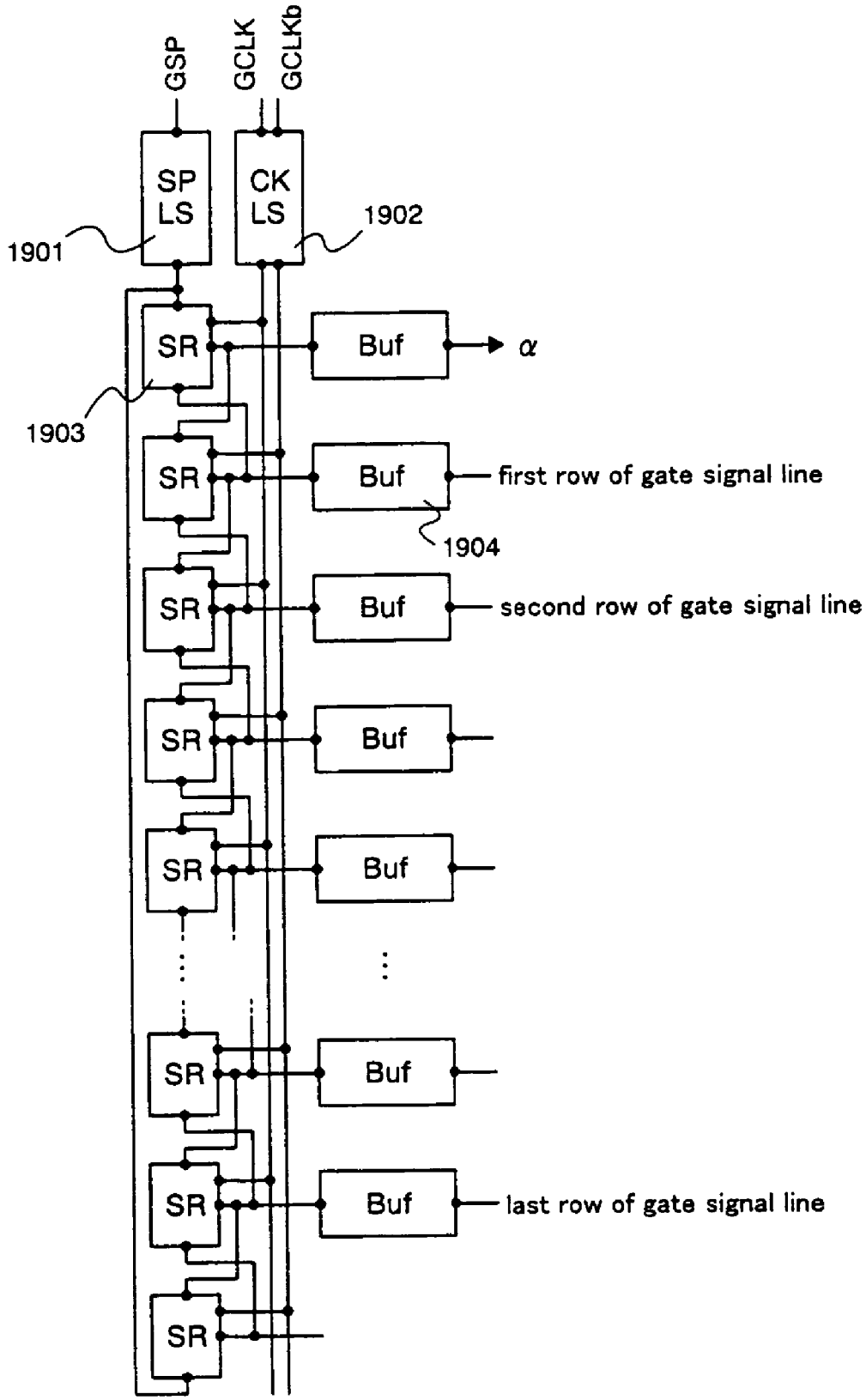
FIG. 19 is a structural diagram of a gate signal line driver circuit structuring a light emitting device of the present invention.

FIG. 19 is a diagram showing the circuit structure of a gate signal line driver circuit. The gate signal line driver circuit has a shift register 1903 and a buffer 1904.

A gate side clock signal (GCLK), a gate side clock inverted signal (GLKb), and a gate side start pulse (GSP) are input to the gate signal line driver circuit. The input signals are input after undergoing amplitude transformation by level shifters 1901 and 1902.

Note that the shift register 1903, the buffer 1904, the start pulse level shifter 1901, and the clock signal level shifter 1902 are similar to those used in the source signal line driver circuit, and therefore an explanation of their structure and operation is omitted here.

In FIG. 19, a gate signal line of a row denoted by a reference symbol α is formed as a dummy stage because a first row of pixels can not obtain gate signal line selection pulse input for the previous row.

The display device introduced here and manufactured by using driver circuits and pixels shown in Embodiment Modes 1 and 2 is structured by using only TFTs of the same conductivity type, and therefore a portion of a doping process during manufacturing can be eliminated. In addition, it becomes possible to reduce the number of photomasks. It is also possible to resolve the problem of an increase in consumption current due to an expanded signal amplitude by using circuits that apply the bootstrap method, as discussed above.

Embodiment 3

Pixels having erasure gate signal lines are explained in Embodiment 1, but with this type of pixel, selection timing for writing gate signal lines differs from selection timing for erasure gate signal lines. In addition, the pulse shape also differs. Therefore, one of the gate signal line driver circuits shown in FIG. 20B which are disposed on both sides of the pixel portion may be structured as a writing gate signal line driver circuit, and the other may be structured as an erasure gate signal line driver circuit. Circuit structures may be similar to those explained in Embodiment 2, and therefore a detailed explanation thereof is omitted here.

Embodiment 4

This embodiment gives a description on a method of manufacturing TFTs for driving circuit provided in a pixel portion and in the periphery of the pixel potion formed on the same substrate.

Figure 6A:
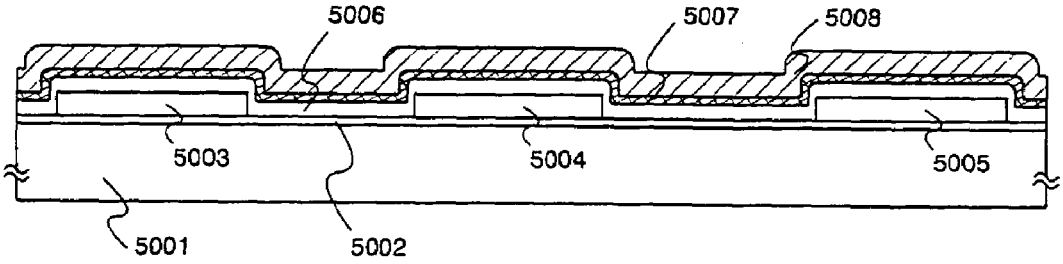
FIGS. 6A to 6D are diagrams showing a method of manufacturing a light emitting device of the present invention.

First, as shown in FIG. 6A, a base film 5002 is formed from an insulating film such as a silicon oxide film, a silicon nitride film, and a silicon oxynitride film on a glass substrate 5001. The substrate 5001 is formed of barium borosilicate glass typical example of which is Corning # 7059 glass or Corning #1737 glass (product of Corning Incorporated), or of aluminoborosilicate glass. The base film 5002 is, for example, (not shown) a laminate of a silicon oxynitride film that is formed from $SiH_4$, $NH_3$, and $N_2O$ by plasma CVD to a thickness of 10 to 200 nm (preferably 50 to 100 nm) and a silicon oxynitride hydride film formed from $SiH_4$ and $N_2O$ by plasma CVD to a thickness of 50 to 200 nm (preferably 100 to 150 nm).

A semiconductor film having an amorphous structure is crystallized by laser crystallization or a known thermal crystallization method to form a crystalline semiconductor film. The crystalline semiconductor film makes island-like semiconductor layers 5003 to 5005. The island-like semiconductor layers 5003 to 5005 each have a thickness of 25 to 80 nm (preferably 30 to 60 nm). No limitation is put on the choice of material of the crystalline semiconductor film but it is preferable to use silicon or a silicon germanium (SiGe) alloy.

When the crystalline semiconductor film is formed by laser crystallization, a pulse oscillation-type or continuous wave excimer laser, YAG laser, or $YVO_4$ laser is used. Laser light emitted from a laser as those given in the above is desirably collected into a linear beam by an optical system before irradiating the semiconductor film. Conditions of crystallization are set suitably by an operator. However, if an excimer laser is used, the pulse oscillation frequency is set to 30 Hz and the laser energy density is set to 100 to 400 mJ/cm$^2$ (typically 200 to 300 mJ/cm$^2$). If a YAG laser is used, second harmonic thereof is employed and the pulse oscillation frequency is set to 1 to 10 kHz while setting the laser energy density to 300 to 600 mJ/cm$^2$ (typically 350 to 500 mJ/cm$^2$). The laser light is collected into a linear beam having a width of 100 to 1000 μm, for example, 400 μm, to irradiate the entire substrate. The substrate is irradiated with the linear laser light with the beams overlapping each other at an overlap ratio of 80 to 98%.

Next, a gate insulating film 5006 is formed so as to cover the island-like semiconductor layers 5003 to 5005. The gate insulating film 5006 is formed from an insulating film containing silicon by plasma CVD or sputtering to a thickness of 40 to 150 nm. In this embodiment, a silicon oxynitride film having a thickness of 120 nm is used. Needless to say, the gate insulating film is not limited to a silicon oxynitride film but may be a single layer or a laminate of other insulating films containing silicon. For example, if a silicon oxide film is used for the gate insulating film, the film is formed by plasma CVD in which TEOS (tetraethyl orthosilicate) is mixed with $O_2$ and the reaction pressure is set to 40 Pa, the substrate temperature to 300 to 400° C., the frequency is set high to 13.56 MHz, and the power density is set to 0.5 to 0.8 W/cm$^2$ for electric discharge. The silicon oxide film thus formed can provide the gate insulating film with excellent characteristics when it is subjected to subsequent thermal annealing at 400 to 500° C.

On the gate insulating film 5006, a first conductive film 5007 and a second conductive film 5008 for forming gate electrodes are formed. In this embodiment, the first conductive film 5007 is a Ta film with a thickness of 50 to 100 nm and the second conductive film 5009 is a W film with a thickness of 100 to 300 nm (Fig. A).

The Ta film is formed by sputtering in which Ta as a target is sputtered with Ar. In this case, an appropriate amount of Xe or Kr is added to Ar to ease the internal stress of the Ta film and thus prevent the Ta film from peeling off. The resistivity of a Ta film in a phase is about 20 μΩcm and is usable for a gate electrode. On the other hand, the resistivity of a Ta film in β phase is about 180 μΩcm and is not suitable for a gate electrode. A Ta film in α phase can readily be obtained when a base with a thickness of about 10 to 50 nm is formed from tantalum nitride (TaN) that has a crystal structure approximate to that of the α phase Ta film.

The W film is formed by sputtering with W as a target. Alternatively, the W film may be formed by thermal CVD using tungsten hexafluoride ($WF_6$). In either case, the W film has to have a low resistivity in order to use the W film as a gate electrode. A desirable resistivity of the W film is 20 μΩcm or lower. The resistivity of the W film can be reduced by increasing the crystal grain size but, if there are too many impurity elements such as oxygen in the W film, crystallization is inhibited to raise the resistivity. Accordingly, when the W film is formed by sputtering, a W target with a purity of 99.9999% is used and a great care is taken not to allow impurities in the air to mix in the W film being formed. As a result, the W film can have a resistivity of 9 to 20 μΩcm.

Although the first conductive film 5007 is a Ta film and the second conductive film 5008 is a W film in this embodiment, there is no particular limitation. The conductive films may be formed of any element selected from the group consisting of Ta, W, Mo, Al, and Cu, or of an alloy material or compound material mainly containing the elements listed above. A semiconductor film, typically a polycrystalline silicon film doped with an impurity element such as phosphorus, may be used instead. Other desirable combinations of materials for the first and second conductive films than the one shown in this embodiment include: tantalum nitride (TaN) for the first conductive film 5007 and W for the second conductive film 5008; tantalum nitride (TaN) for the first conductive film 5007 and Al for the second conductive film 5008; and tantalum nitride (TaN) for the first conductive film 5007 and Cu for the second conductive film 5008.

Next, a resist mask 5009 is formed to carry out first etching treatment for forming electrodes and wiring lines. In this embodiment, ICP (inductively coupled plasma) etching is employed in which $CF_4$ and $Cl_2$ are mixed as etching gas and an RF (13.56 MHz) power of 500 W is given to a coiled electrode at a pressure of 1 Pa to generate plasma. The substrate side (sample stage) also receives an RF (13.56 MHz) power of 100 W so that a substantially negative self-bias voltage is applied. When the mixture of $CF_4$ and $Cl_2$ is used, the W film and the Ta film are etched to the same degree.

Under the above etching conditions, if the resist mask is properly shaped, the first conductive film and the second conductive film are tapered around the edges by the effect of the bias voltage applied to the substrate side. The angle of the tapered portions is 15° to 45°. In order to etch the conductive films without leaving any residue on the gate insulating film, the etching time is prolonged by about 10 to 20%. The selective ratio of the W film to the silicon oxynitride film is 2 to 4 (typically 3), and therefore a region where the silicon oxynitride film is exposed is etched by about 20 to 50 nm by the over-etching treatment. In this way, first shape conductive layers 5010 to 5013 comprising first conductive layers 5010*a* to 5013*a* and second conductive layers 5010*b* to 5013*b* are formed from the first conductive film and the second conductive film through the first etching treatment. At this point, regions of the gate insulating film 5006 that are not covered with the first shape conductive layers 5010 to 5013 are etched and thinned by about 20 to 50 nm. (FIG. 6B)

Figure 6B:
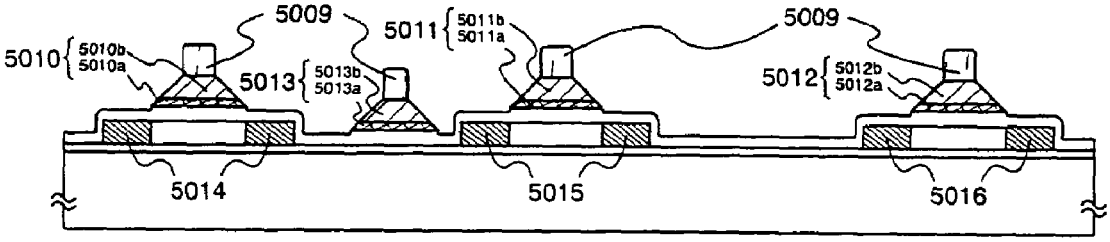

First doping treatment is conducted next for doping of an impurity element that gives the N-type conductivity (FIG. 6B). Ion doping or ion implanting is employed. In ion doping, the dose is set to $1\times10^{13}$ to $5\times10^{14}$ atoms/cm$^2$ and the acceleration voltage is set to 60 to 100 keV. The impurity element that gives the N-type conductivity is an element belonging to Group 15, typically, phosphorus (P) or arsenic (As). Here, phosphorus (P) is used. In this case, the conductive layers 5010 to 5013 serve as masks against the impurity element that gives the N-type conductivity, and first impurity regions 5014 to 5016 are formed in a self-aligning manner. The first impurity regions 5014 to 5016 each contain the impurity element that gives the N-type conductivity in a concentration of $1\times10^{20}$ to $1\times10^{21}$ atoms/cm$^3$.

Figure 6C:
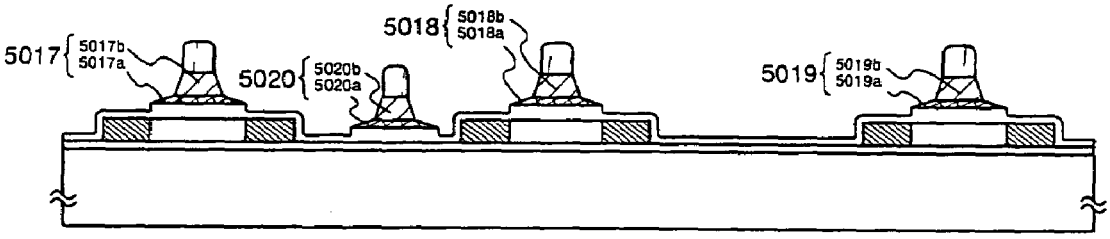

Next, as shown in FIG. 6C, a second etching process is performed. The ICP etching method is similarly used in which $CF_4$, $Cl_2$, and $O_2$ are mixed as the etching gases, and an RF power of 500 W is applied to a coil type electrode under a pressure of 1 Pa to generate plasma. An RF power of 50 W is applied to the side of the substrate (sample stage), and a low self bias voltage as compared with the first etching process is applied thereto. In accordance with the conditions, the W film as the second conductive layer is anisotropically etched, and the Ta film as the first conductive layer is anisotropically etched at an etching rate lower than the W film to form second shape conductive layers 5017 to 5020 (first conductive layers 5017*a* to 5020*a* and second conductive layers 5017*b* to 5020*b*). Reference numeral 5006 designates a gate insulating film, and regions which are not covered with the second shape conductive layers 5017 to 5020 are etched into a film thickness of about 20 to 50 nm, to for thin regions.

The reaction of the W film and the Ta film to etching by the mixture gas of $CF_4$ and $Cl_2$ can be deduced from the vapor pressure of radical or ion species generated and of reaction products. Comparing the vapor pressure among fluorides and chlorides of W and Ta, $WF_6$ that is a fluoride of W has an extremely high vapor pressure while the others, namely, $WCl_5$, $TaF_5$, and $TaCl_5$ have a vapor pressure of about the same degree. Accordingly, the W film and the Ta film are both etched with the mixture gas of $CF_4$ and $Cl_2$. However, when an appropriate amount of $O_2$ is added to this mixture gas, $CF_4$ and $O_2$ react to each other to be changed into CO and F, generating a large amount of F radicals or F ions. As a result, the W film whose fluoride has a high vapor pressure is etched at an increased etching rate. On the other hand, the etching rate of the Ta film is not increased much when F ions are increased in number. Since Ta is more easily oxidized than W, the addition of $O_2$ results in oxidization of the surface of the Ta film. The oxide of Ta does not react with fluorine or chlorine and therefore the etching rate of the Ta film is reduced further. Thus a difference in etching rate is introduced between the W film and the Ta film, so that the etching rate of the W film is set faster than the etching rate of the Ta film.

Figure 6D:
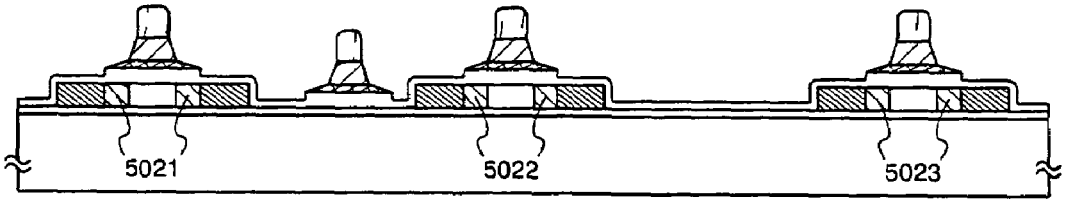
Figure 7A:
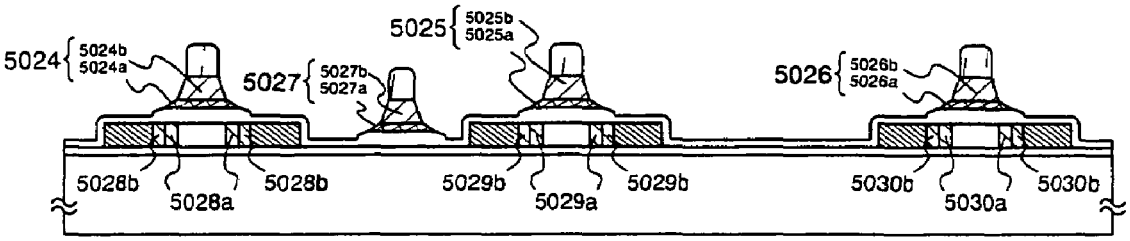
FIGS. 7A to 7C are diagrams showing the method of manufacturing a light emitting device of the present invention.

Then second doping treatment is conducted (FIG. 6D). In the second doping treatment, the film is doped with an impurity element that gives the N-type conductivity in a dose smaller than in the first doping treatment and at a high acceleration voltage. For example, the acceleration voltage is set to 70 to 120 keV and the dose is set to $1\times10^{13}$ atoms/cm$^2$ to form new impurity regions inside the first impurity regions that are formed in the island-like semiconductor layers in FIG. 6B. While the second conductive layers 5017*b* to 5020*b* are used as masks against the impurity element, regions under the first conductive layers 5017*a* to 5020*a* are also doped with the impurity element. Thus formed are second impurity regions 5021 to 5023 overlapping the first conductive layer. Next, as shown in FIG. 7A, a third etching process is performed. In this embodiment, an ICP etching device is employed and $Cl_2$ is used as etching gas. Etching is conducted for 70 seconds, setting the flow rate of $Cl_2$ to 60 (sccm), and an RF power of 350 W is applied to a coil type electrode under a pressure of 1 Pa to generate plasma. An RF power is also applied to the side of the substrate (sample stage) so that a substantially negative self-bias voltage is applied. Through the third etching process, the first conductive layer is etched to reduce the region, thereby third shape conductive layers 5024 to 5027 (first conductive layers 5024*a* to 5027*a* and second conductive layers 5024*b* to 5027*b*) are formed. The second impurity regions 5021 to 5023 include the second impurity regions 5028*a* to 5030*a* overlapping the first conductive layer and the third impurity region 5028*b* to 5030*b* that are not covered with the first conductive layer.

Through the steps above, the impurity regions are formed in the respective island-like semiconductor layers. The third shape conductive layers 5024 to 5026 overlapping the island-like semiconductor layers function as gate electrodes of TFTs. The third shape conductive layer 5027 function as island-like source signal lines.

The impurity elements used to dope the island-like semiconductor layers in order to control the conductivity types are activated. The activation step is carried out by thermal annealing using an annealing furnace. Other activation adoptable methods include laser annealing and rapid thermal annealing (RTA). The thermal annealing is conducted in a nitrogen atmosphere with an oxygen concentration of 1 ppm or less, preferably 0.1 ppm or less, at 400 to 700° C., typically 500 to 600° C. In this embodiment, the substrate is subjected to heat treatment at 500° C. for four hours. However, if the wiring line material used for the third shape conductive layers 5024 to 5027 are weak against heat, the activation is desirably made after an interlayer insulating film (mainly containing silicon) is formed in order to protect the wiring lines and others.

Another heat treatment is conducted in an atmosphere containing 3 to 100% hydrogen at 300 to 450° C. for one to twelve hours, thereby hydrogenating the island-like semiconductor layers. The hydrogenation steps are to terminate dangling bonds in the semiconductor layers using thermally excited hydrogen. Alternatively, plasma hydrogenation (using hydrogen that is excited by plasma) may be employed.

Figure 7B:
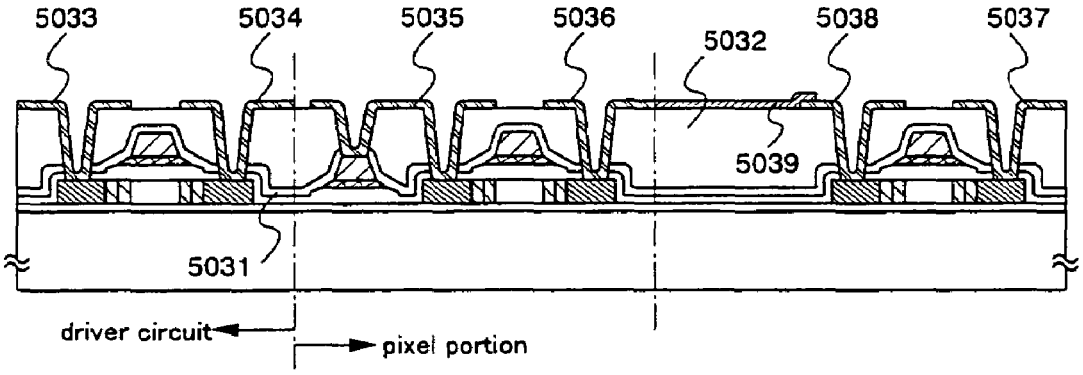

As shown in FIG. 7B, a first interlayer insulating film 5031 is formed next from a silicon oxynitride film with a thickness of 100 to 200 nm. A second interlayer insulating film 5032 is formed thereon from an organic insulating material. Thereafter, contact holes are formed corresponding to the first interlayer insulating film 5031, the second interlayer insulating film 5032, and the gate insulating film 5006. A film made of wiring lines material is formed, whereby connection wiring lines 5033 to 5037 and a connection electrode 5038 are formed by patterning. Then, a pixel electrode 5039 is formed by patterning so as to contact with the connection electrode 5038.

A substrate comprising the wiring lines 5033 to 5037 and the connection electrode 5038 denote an active matrix substrate in this embodiment.

The second interlayer insulating film 5032 is a film made of an organic resin. Examples of the usable organic resin includes polyimide, polyamide, acrylic resin, and BCB (benzocyclobutene). Since planarization is a significant aspect of the role of the second interlayer insulating film 5032, acrylic resin that can level the surface well is particularly preferable. In this embodiment, the acrylic film is thick enough to eliminate the level differences caused by the TFTs. An appropriate thickness of the film is 1 to 5 μm (preferably 2 to 4 μm).

The contact holes are formed by dry etching or wet etching, and include contact holes reaching the impurity regions 5014 to 4016 having the N-type conductivity, the source signal lines 5027, the gate signal lines (not shown), a power supply line (not shown), and gate electrodes 5024 to 5026 (not shown) respectively.

Further, a lamination film of a three layer structure, in which a 100 nm thick Ti film, a 300 nm thick Al film containing Ti, and a 150 nm thick Ti film are formed in succession by sputtering e wirings 5033 to 5038. Of course, other conductive films may be used.

In the present embodiment, the pixel electrode (a reflecting electrode) 5039 are formed by MgAg or the like with a thickness of 200 nm, and then patterned. The pixel electrode 5039 is formed in contact with the connection electrode 5038.

Figure 7C:
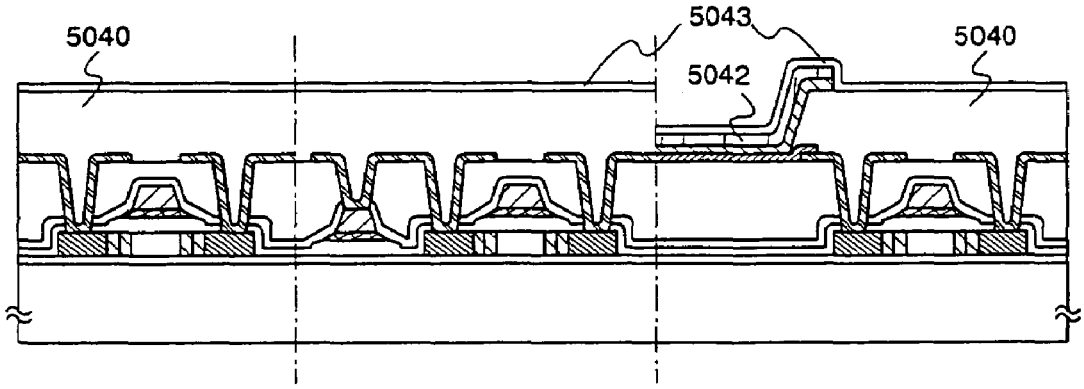
Figure 8A:
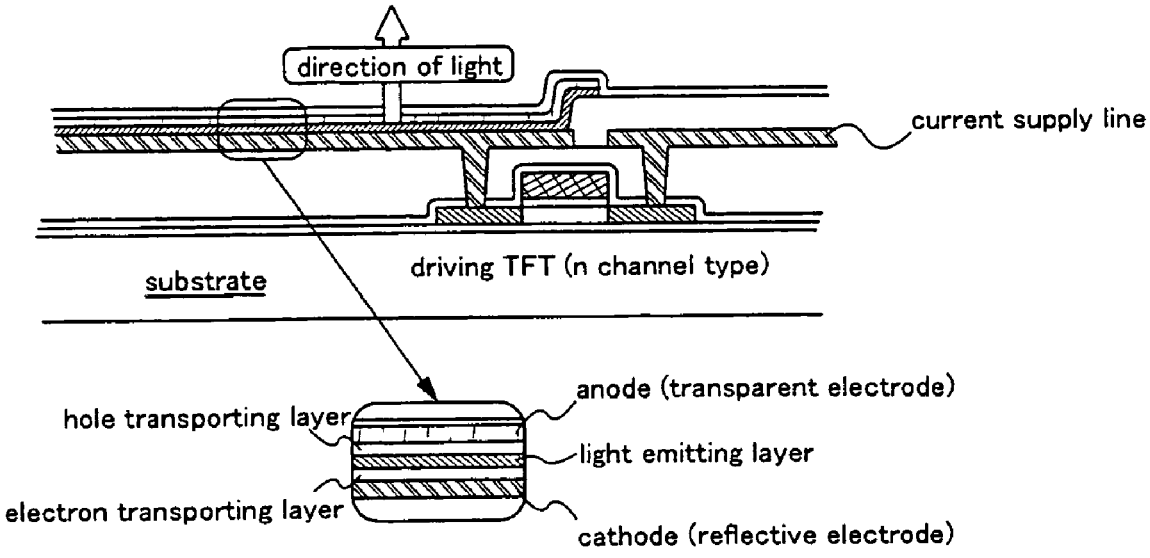
FIGS. 8A and 8B are diagrams showing pixel portion cross section of light emitting devices for cases of upper surface light emission and lower surface light emission, respectively.
Figure 8B:
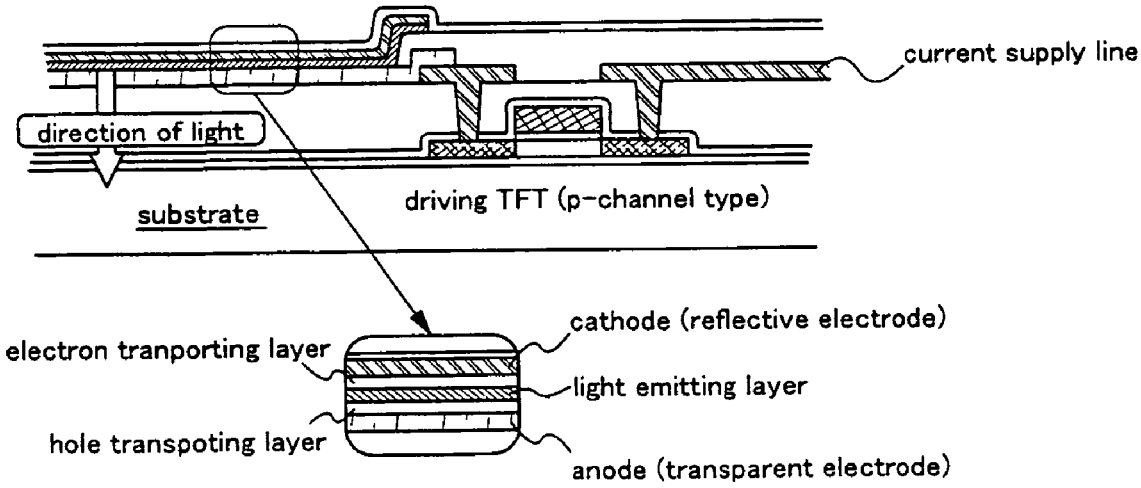

Next, as shown in FIG. 7C, an insulating film containing organic material such as acrylic resin is formed to a thickness of 1 to 3 μm and an aperture is opened in the film at a position corresponding to the position of the pixel electrode 5039. A third interlayer insulation film 5040 is thus formed. When the aperture is formed, it is preferable that the side wall is etched so as to become a tapered shape. If the side walls of the aperture is not smooth enough, the level difference can make degradation of an EL layer into a serious problem.

An EL layer 5041 and an opposite electrode (transparent electrode) 5042 are formed by vacuum evaporation successively. The thickness of the EL layer is set to 80 to 200 nm (typically 100 to 120 nm). The thickness of the pixel electrode (the transparent electrode) 5042 is set to 110 nm.

In this step, the EL layer and the pixel electrode (transparent electrode) are formed in a pixel for red light, then in a pixel for green light, and then in a pixel for blue light. The EL layers have low resistivity to solutions, inhibiting the use of photolithography. Therefore an EL layer and the pixel electrode (transparent electrode) of one color cannot be formed together with an EL layer and the pixel electrode (transparent electrode) of another color. Then EL layers and the pixel electrode (the transparent electrode) are selectively formed in pixels of one color while covering pixels of the other two colors with a metal mask. Formed here are three types of EL elements in accordance with R, G, and B. Instead, a white light emitting EL element combined with color filters, a blue light or bluish green light emitting element combined with fluorophors (fluorescent color conversion layers: CCM) may be used.

Note that a known material can be used for the EL layer 5041. A preferable known material is an organic material, taking the driving voltage into consideration.

Through the step above, the cathode made of MgAg and the anode made of EL layer and the transparent conductive film are formed. Then, a passivation film is formed from a silicon nitride film as a protective film 5043 with a thickness of 50 to 300 nm. The protective film 5043 protects the EL layer from moisture and the like.

In practice, the device reaching the state of FIG. 7C is packaged (enclosed) using a protective film that is highly airtight and allows little gas to transmit (such as a laminate film and a UV-curable resin film) or a light-transmissive seal, so as to further avoid exposure to the outside air. A space inside the seal may be set to an inert atmosphere or a hygroscopic substance (barium oxide, for example) may be placed there to improve the reliability of the EL element.

After securing the airtightness through packaging or other processing, a connector (flexible printed circuit: FPC) is attached for connecting an external signal terminal with a terminal led out from the elements or circuits formed on the substrate. The device in a state that can be shipped is called display device in this specification.

By following the process shown in this embodiment, the number of photo masks needed in manufacturing an active matrix substrate can be reduced to four (an island-like semiconductor layer pattern, the first wiring lines pattern including the gate wiring lines, an island-like source wiring line, and capacity wiring lines, contact hole patterns, the second wiring line pattern including the connection electrode). As a result, the process is cut short to reduce the manufacture cost and improve the yield.

Embodiment 5

An example of a case in which the pixels and the driver circuits in the periphery are structured using n-channel TFTs is explained in Embodiment 4, but it is also possible to implement the present invention by using p-channel TFTs.

For the case of n-channel TFTs Impurity regions referred to as overlap regions are formed in regions overlapping with gate electrodes in order to control hot carrier degradation and the like. In contrast, there is little influence due to hot carrier degradation for the case of p-channel TFTs, and therefore it is not particularly necessary to form overlap regions. It is therefore possible to perform manufacturing by simpler process steps.

Figure 22A:
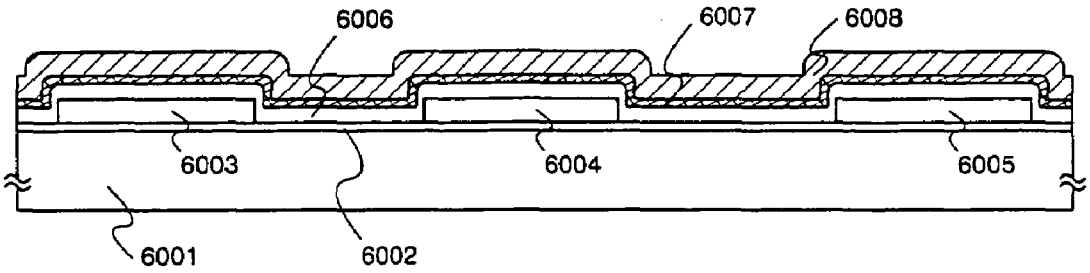
FIGS. 22A to 22C are diagrams showing an example of a method of manufacturing a light emitting device of the present invention.

A base film 6002 is formed on an insulating substrate 6001 made from a material such as glass, island shape semiconductor layers 6003 to 6005, a gate insulating film 6006, and conductive layers 6007 and 6008 are then formed as shown in FIG. 22A in accordance with Embodiment 4. The conductive layers 6007 and 6008 are shown here as a laminate structure, but a single layer structure may also be used without any particular problems.

Figure 22B:
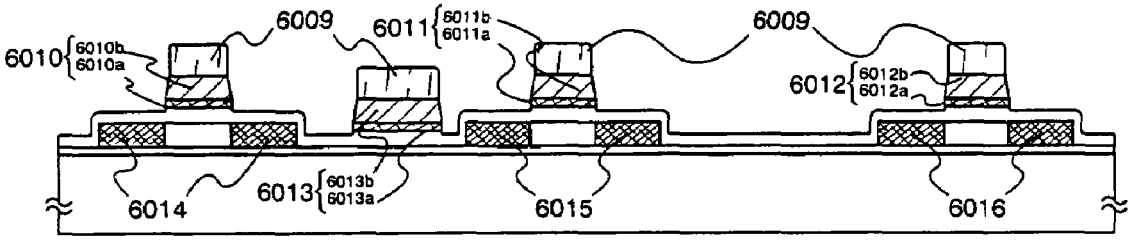

Next, as shown in FIG. 22B, a mask 6009 is formed from resist, and a first etching process is performed. Anisotropic etching is performed in Embodiment 4 by utilizing selectivity due to the material properties of the laminate structure conductive layers. However, it is not particularly necessary to form regions that become overlap regions here, and therefore normal etching may be performed. A region that becomes thinner by an amount on the order of 20 to 50 nm due to etching at this point is formed in the gate insulating film 6006.

A first doping process for adding an impurity element that imparts p-type conductivity to the island shape semiconductor layers is performed next. Conductive layers 6010 to 6012 are used as masks against the impurity element, and the impurity regions are formed in a self-aligning manner. Boron (B) and the like are typically used as the impurity element that imparts p-type conductivity. The impurity regions are formed by ion doping using diborane ($B_2H_6$) here, and the impurity concentration within the semiconductor layers is set from $2\times10^{20}$ to $2\times10^{21}$ atoms/cm$^3$.

Figure 22C:
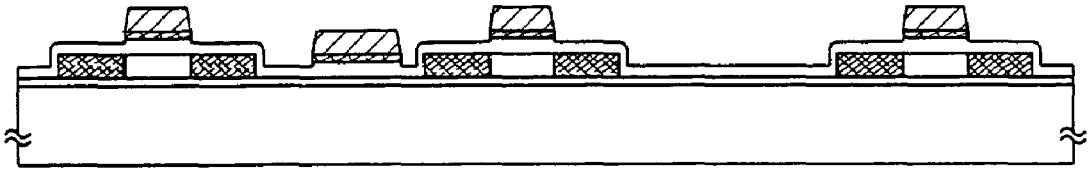

The resist mask is then removed, and the state of FIG. 22C is obtained. Manufacturing then continues in accordance with the process steps from FIG. 7B onward in Embodiment 4.

Note that it is preferable that a structure which is the reverse of the EL element structure shown in Embodiment 4 be formed in Embodiment 5 because the TFTs forming the pixels and the peripheral driver circuits are p-channel TFTs. That is, the pixel electrode 5032 of FIG. 7B used in Embodiment 4 is formed by a transparent electrode and used as an EL element anode. In addition, after forming an EL layer, a reflecting electrode is formed from a material such as MgAg, and used as a cathode of the EL element. Light generated in the EL element is therefore emitted toward the substrate on which the TFTs are formed with this structure.

Embodiment 6

Figure 24A:
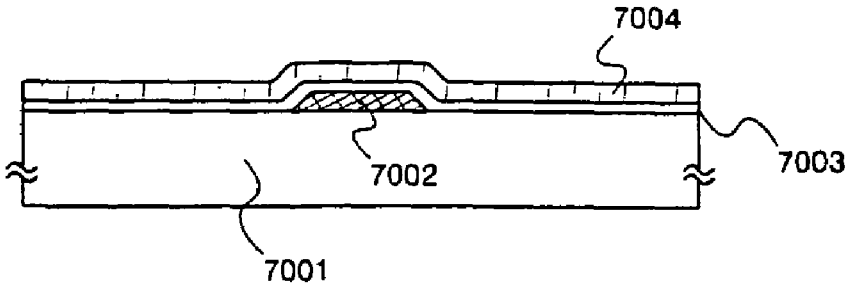
FIGS. 24A to 24C are diagrams showing cross sections of a dual gate TFT, and a method of manufacturing thereof.
Figure 24B:
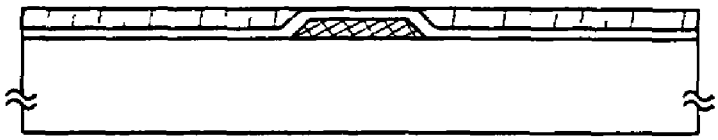
Figure 24C:
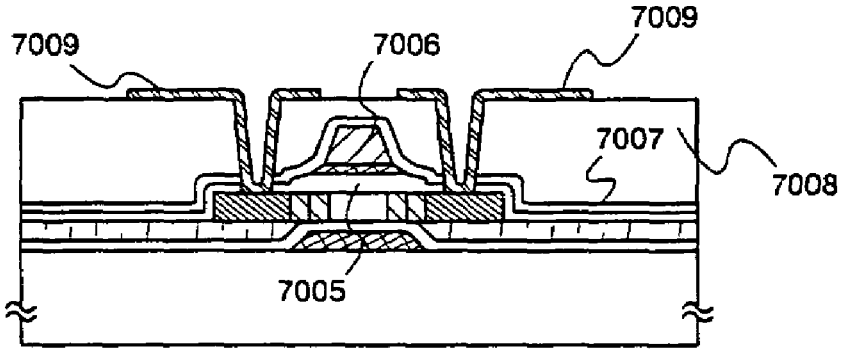

The TFTs structuring the driver circuits and the pixels are TFTs having a normal single gate structure in the processes shown in Embodiment 4, but the present invention may also be implemented using TFTs with structures having a plurality of gate electrodes sandwiching active layers, as shown in FIG. 24C. An explanation of a process of manufacture is explained below.

A conductive film is formed from a conductive material on a substrate 7001 made from barium borosilicate glass, alumino borosilicate glass, or the like, typically Corning Corp. #7059 glass or #1737 glass, and a lower gate electrode 7002 is formed by patterning as shown in FIG. 24A. There are no particular limitations placed on the material used to form the lower gate electrode, provided that it is a conductive material. Materials such as Ta and W are typically used.

A first insulating film 7003 is formed next. The first insulating film 7003 is formed with a thickness of 10 to 50 nm using silicon oxynitride.

The surface at the time when the first insulating film 7003 is formed has unevenness as shown in FIG. 24A, caused by the lower gate electrode 7002. Considering later manufacturing processes, it is preferable to perform leveling of the unevenness. CMP (chemical mechanical polishing) is used as a leveling means here. CMP is one method for obtaining a dense, smooth surface by performing chemical processing of the surface of an object to be polished, making the surface in an easy to polish state, and then performing mechanical polishing.

A silicon oxide film or a silicon oxynitride film is formed as a leveling film 7004 having a thickness of 0.5 to 1 μm on the first insulating film 7003. A mixture in which fumed silica particles obtained by thermal decomposition of silicon chloride gas are dispersed in an aqueous KOH solution, for example, may be used as a CMP polishing agent (slurry) to the leveling film 704. An amount on the order of 0.5 to 1 μm is removed from the surface of the leveling film 7004 by polishing with CMP, leveling the surface.

A state in which the surface is leveled is thus obtained, as shown in FIG. 24B. TFTs may then be formed in accordance with Embodiment 4, forming peripheral circuits and pixels.

The TFTs manufactured here have gate electrodes and lower gate electrodes that overlap, sandwiching an active layer. For cases in which a quick response is demanded, such as with switching circuits, signals may be input to both the lower gate electrode 7002 and the gate electrode 7006. By inputting the same signal into both the gate electrodes, depletion of the channel region in the active layer advances quickly, the electric field effect mobility increases, and the electric current capacity can be raised. The quick response characteristics can thus be expected.

On the other hand, for cases in which uniformity of characteristics or a low off leak current is demanded, as with pixel portion driver TFTs, signals may be input to the gate electrode while the lower gate electrode is held at a certain fixed electric potential. The term certain fixed electric potential denotes an electric potential such that the TFT is reliably kept in an off state when the electric potential is applied to the gate electrode of the TFT. Typically, the lower gate electrode is connected to a low electric potential side power source such as VSS if the TFT is an n-channel TFT, and is connected to a high electric potential power source such as VDD if the TFT is a p-channel TFT. In this case, dispersion in the value of the threshold voltage can be reduced when compared to TFTs having structures that do not possess a lower gate electrode. In addition, this is effective because a reduction in the off leak current can also be anticipated.

Embodiment 7

A semiconductor device of the present invention can be applied to fabrication of a display device used for various electronic equipment. Such electronic equipment includes a portable information terminal (electronic notebook, mobile computer, portable telephone, etc.), a video camera, a digital camera, a personal computer, a television, a portable telephone, and the like. FIGS. 23A to 23G show examples of those.

Figure 23A:
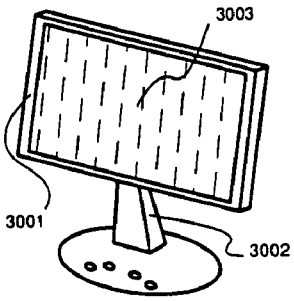
FIGS. 23A to 23G are diagrams showing examples of electronic equipment to which the present invention can be applied.

FIG. 23A shows an OLED display which is constituted by a housing 3001, a supporting stand 3002, a display portion 3003, and the like. The semiconductor device of the present invention can be applied to the fabrication of the display portion 3003.

Figure 23B:
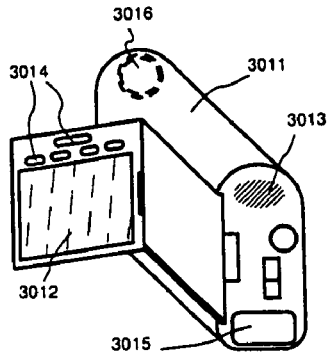

FIG. 23B shows a video camera which is constituted by a main body 3011, a display portion 3012, an audio input portion 3013, an operation switch 3014, a battery 3015, an image receiving portion 3016, and the like. The semiconductor device of the present invention can be applied to the fabrication of the display portion 3012.

Figure 23C:
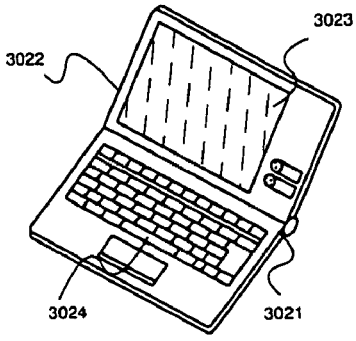

FIG. 23C shows a notebook personal computer which is constituted by a main body 3021, a housing 3022, a display portion 3023, a keyboard 3024, and the like. The semiconductor device of the present invention can be applied to the fabrication of the display portion 3023.

Figure 23D:
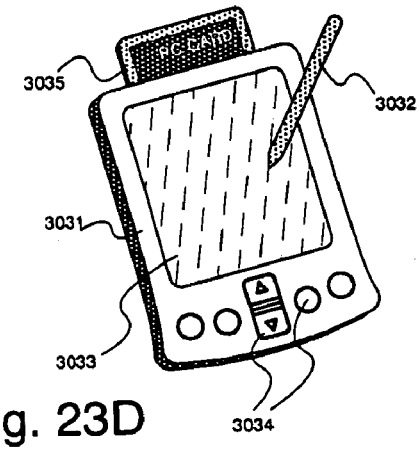

FIG. 23D shows a portable information terminal which is constituted by a main body 3031, a stylus 3032, a display portion 3033, an operation button 3034, an external interface 3035, and the like. The semiconductor device of the present invention can be applied to the fabrication of the display portion 3033.

Figure 23E:
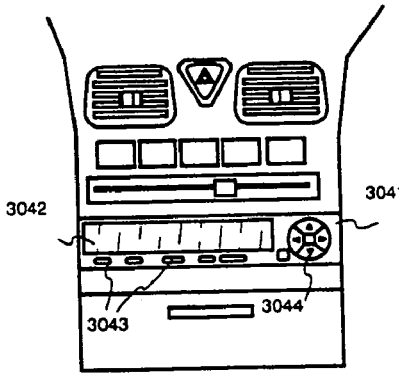

FIG. 23E shows a sound reproducing system, specifically an on-vehicle audio apparatus, which is constituted by a main body 3041, a display portion 3042, operation switches 3043 and 3044, and the like. The semiconductor device of the present invention can be applied to the fabrication of the display portion 3042. Additionally, although the on-vehicle audio apparatus is illustrated in this example, the invention can also be used for a portable or household audio apparatus.

Figure 23F:
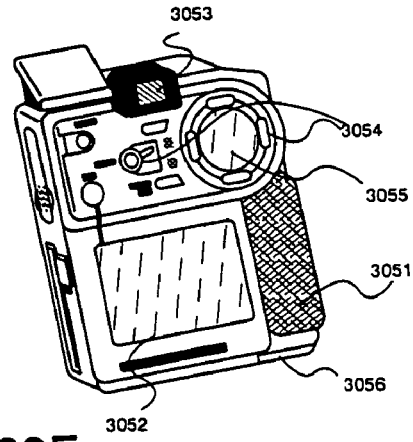

FIG. 23F shows a digital camera which is constituted by a main body 3051, a display portion (A) 3052, an eyepiece portion 3053, an operation switch 3054, a display portion (B) 3055, a battery 3056, and the like. The semiconductor device of the present invention can be applied to the fabrication of the display portion (A) 3052 and the display portion (B) 3055.

Figure 23G:
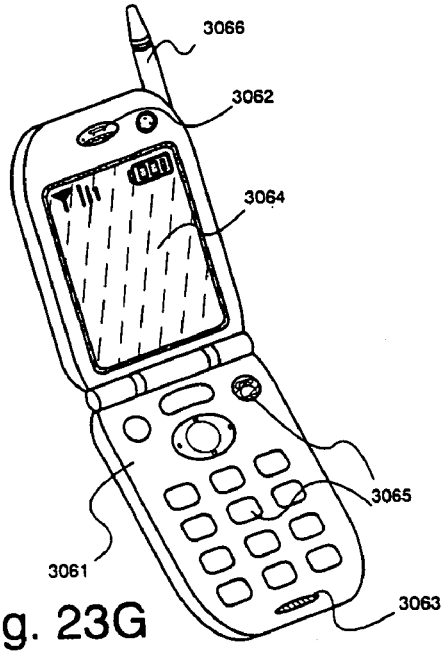

FIG. 23G shows a portable telephone which is constituted by a main body 3061, an audio output portion 3062, an audio input portion 3063, a display portion 3064, an operation switch 3065, an antenna 3066, and the like. The semiconductor device of the present invention can be applied to the fabrication of the display portion 3064.

Note that, the examples set forth above are merely examples, and the present invention is not limited to these applications.

In the light emitting device of the present invention, the pixel portion and the driver circuits in the periphery are formed as integrated by using TFTs of the same conductivity type. A portion of the doping process can be eliminated, and in addition, the number of masks can be reduced, which contributes to an increased in throughput and reduction in costs.

In addition, the light emitting device of the present invention possesses a novel structure corresponding to a bootstrap method, and the voltage amplitude of signals for driving the pixels can be made smaller. This contributes to a reduction in the electric power consumption of the light emitting device.

What is claimed is:

1. A light emitting device comprising a plurality of pixels, wherein:

each of the plurality of pixels which is scanned in a number m row (where m is a natural number, and $1 \leqq m$) has a source signal line, a gate signal line scanned in the number m row, a current supply line, a switching transistor, a driver transistor, a light emitting element, and a voltage compensation circuit;

the switching transistor, the driver transistor, and the voltage compensation circuit are structured using single polarity transistors of the same conductivity type;

the voltage compensation circuit has a first transistor, a second transistor, a third transistor, a first capacitor, and a second capacitor;

a gate electrode of the switching transistor is electrically connected to a writing gate signal line scanned in the number m row;

an input electrode of the switching transistor is electrically connected to the source signal line;

an output electrode of the switching transistor is electrically connected to a first electrode of the first capacitor;

a gate electrode of the first transistor is electrically connected to a writing gate signal line scanned in a number (m−1) row;

an input electrode of the first transistor is electrically connected to the gate signal line scanned in the number m row;

an output electrode of the first transistor is electrically connected to the first electrode of the first capacitor;

a gate electrode of the second transistor is electrically connected to the writing gate signal line scanned in the number (m−1) row;

an input electrode of the second transistor is electrically connected to the gate signal line scanned in the number m row;

an output electrode of the second transistor is electrically connected to a second electrode of the first capacitor;

a gate electrode of the third transistor is electrically connected to the output electrode of the switching transistor;

an input electrode of the third transistor is electrically connected to an erasure gate signal line scanned in the number m row;

an output electrode of the third transistor is electrically connected to the second electrode of the first capacitor;

a gate electrode of the driver transistor is electrically connected to the output electrode of the first transistor and to the gate electrode of the third transistor;

an input electrode of the driver transistor is electrically connected to the current supply line;

an output electrode of the driver transistor is electrically connected to one electrode of the light emitting element; and the voltage compensation circuit amplifies or transforms the amplitude of signals input from the input electrode of the switching transistor, and imparts the amplified or transformed signals to the gate electrode of the driver transistor.

2. A light emitting device according to claim 1, wherein the first capacitor is a capacitance between the gate electrode of the third transistor, and the input electrode or the output electrode of the third transistor.

3. A light emitting device according to claim 1, wherein the first capacitor is a capacitance constituted of: two materials selected from the group consisting of an active layer material, a gate electrode material, and a wiring material; and an insulating film between the two materials.

4. A light emitting device according to claim 1, wherein the voltage amplitude of signals input to the input electrode of the switching transistor from the source signal line is equal to or less than the voltage amplitude of signals input to the gate electrode of the driver transistor.

5. A light emitting device according to claim 1, wherein:

each of the plurality of single polarity transistors structuring a source signal line driver circuit, a gate signal line driver circuit, and the plurality of pixels has:

a lower gate electrode;

a first insulating film formed contacting the lower gate electrode;

an active layer formed contacting the first insulating film;

a second insulating film formed contacting the active layer; and a gate electrode formed contacting the second insulating film; the active layer has a channel forming region; and the gate electrode and the lower gate electrode are placed in positions such that they overlap, through the channel forming region.

6. A light emitting device according to claim 5, wherein the gate electrode and the lower gate electrode are electrically connected.

7. A light emitting device according to claim 5, wherein a fixed electric potential $V_0$ is input to the lower gate electrode.

8. A light emitting device according to claim 7, wherein:

the fixed electric potential $V_0$ satisfies an inequality $V_0$<VthN if the plurality of single polarity transistors each has n-channel type polarity and the minimum threshold voltage of the transistors is VthN; and the fixed electric potential $V_0$ satisfies an inequality VthP <$V_0$ if the plurality of single polarity transistors each has p-channel type polarity and the maximum threshold voltage of the transistors is VthP.

9. A light emitting device according to claim 1, wherein the light emitting device is used for an electronic equipment selected from the group consisting of an electronic notebook, a mobile computer, a portable telephone, a video camera, a digital camera, a personal computer and a television.

10. A display device comprising:

a pixel comprising:

a first transistor comprising a gate electrode electrically connected to a first gate signal line;

a second transistor comprising a gate electrode electrically connected to a second gate signal line and an input electrode electrically connected to the first gate signal line;

a third transistor comprising a gate electrode electrically connected to the first transistor and the second transistor; and a fourth transistor comprising a gate electrode electrically connected to the gate electrode of the third transistor and an output electrode electrically connected to a light emitting element, wherein the first transistor, the second transistor and the third transistor have the same conductivity type.

11. A display device according to claim 10, further comprising a capacitor electrically connected between the gate electrode of the third transistor and an output electrode of the third transistor.

12. A display device according to claim 10, further comprising a driver circuit comprising a plurality of transistors having the same conductivity type as the first, the second, and the third transistors.

13. A display device according to claim 10, wherein a digital image signal is inputted to the pixel.

14. A display device according to claim 10, wherein the display device is used for an electronic equipment selected from the group consisting of an OLED display, a video camera, a notebook personal computer, a portable information terminal, a sound reproducing system, a digital camera and a portable telephone.

15. A display device according to claim 10, wherein an electric potential of the gate electrode of the third transistor is in a floating state when the first transistor and the second transistor are in an off state.

16. A display device according to claim 10, wherein an electric potential of the gate electrode of the third transistor rises when the first transistor and the second transistor are in an off state.

17. A display device comprising:

a pixel comprising:

a first transistor comprising a gate electrode electrically connected to a first gate signal line;

a second transistor comprising a gate electrode electrically connected to a second gate signal line and an input electrode electrically connected to the first gate signal line;

a third transistor comprising a gate electrode electrically connected to output electrodes of the first and second transistors; and a fourth transistor comprising a gate electrode electrically connected to the gate electrode of the third transistor and an input electrode electrically connected to a current supply line, wherein the first transistor, the second transistor and the third transistor have the same conductivity type.

18. A display device according to claim 17, further comprising a capacitor electrically connected between the gate electrode of the third transistor and an output electrode of the third transistor.

19. A display device according to claim 17, further comprising a driver circuit comprising a plurality of transistors having the same conductivity type as the first, the second, and the third transistors.

20. A display device according to claim 17, wherein a digital image signal is inputted to the pixel.

21. A display device according to claim 17, wherein the display device is used for an electronic equipment selected from the group consisting of an OLED display, a video camera, a notebook personal computer, a portable information terminal, a sound reproducing system, a digital camera and a portable telephone.

22. A display device according to claim 17, wherein an electric potential of the gate electrode of the third transistor is in a floating state when the first transistor and the second transistor are in an off state.

23. A display device according to claim 17, wherein an electric potential of the gate electrode of the third transistor rises when the first transistor and the second transistor are in an off state.

24. A display device according to claim 17, further comprising a light emitting element electrically connected to the fourth transistor.

25. A display device comprising:

a pixel comprising:

a first transistor comprising a gate electrode electrically connected to a first gate signal line;

a second transistor comprising a gate electrode electrically connected to a second gate signal line and an input electrode electrically connected to the first gate signal line;

a third transistor comprising a gate electrode electrically connected to output electrodes of the first and second transistors; and a fourth transistor comprising a gate electrode electrically connected to the gate electrode of the third transistor, wherein the first transistor, the second transistor and the third transistor have the same conductivity type.

26. A display device according to claim 25, further comprising a capacitor electrically connected between the gate electrode of the third transistor and an output electrode of the third transistor.

27. A display device according to claim 25, further comprising a driver circuit comprising a plurality of transistors having the same conductivity type as the first, the second, and the third transistors.

28. A display device according to claim 25, wherein a digital image signal is inputted to the pixel.

29. A display device according to claim 25, wherein the display device is used for an electronic equipment selected from the group consisting of an OLED display, a video camera, a notebook personal computer, a portable information terminal, a sound reproducing system, a digital camera and a portable telephone.

30. A display device according to claim 25, wherein an electric potential of the gate electrode of the third transistor is in a floating state when the first transistor and the second transistor are in an off state.

31. A display device according to claim 25, wherein an electric potential of the gate electrode of the third transistor rises when the first transistor and the second transistor are in an off state.

32. A display device according to claim 25, further comprising a light emitting element electrically connected to the fourth transistor.

* * * * *

UNITED STATES PATENT AND TRADEMARK OFFICE

CERTIFICATE OF CORRECTION

PATENT NO. : 7,649,516 B2
APPLICATION NO. : 11/211075
DATED : January 19, 2010
INVENTOR(S) : Azami et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1127 days.

Signed and Sealed this

Twenty-eighth Day of December, 2010

David J. Kappos

David J. Kappos
*Director of the United States Patent and Trademark Office*